US010717943B2

(12) United States Patent
Soto-Castillo et al.

(10) Patent No.: US 10,717,943 B2
(45) **Date of Patent: *Jul. 21, 2020**

(54) INDUSTRIAL LUBRICANT INCLUDING METAL CHALCOGENIDE PARTICLES AND PHOSPHORUS-BASED ADDITIVE

(71) Applicant: Nanotech Industrial Solutions, Inc., Avenel, NJ (US)

(72) Inventors: Roger G. Soto-Castillo, Roselle, NJ (US); Girija S. Chaubey, Avenel, NJ (US); George Diloyan, Cranford, NJ (US)

(73) Assignee: NANOTECH INDUSTRIAL SOLUTIONS, INC., Avenel, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/523,597

(22) Filed: Jul. 26, 2019

(65) Prior Publication Data

US 2019/0345405 A1 Nov. 14, 2019

Related U.S. Application Data

(62) Division of application No. 15/204,541, filed on Jul. 7, 2016, now Pat. No. 10,364,401.

(Continued)

(51) Int. Cl.
*C10M 125/22* (2006.01)
*C10M 135/10* (2006.01)

(Continued)

(52) U.S. Cl.
CPC ..... *C10M 125/22* (2013.01); *C10M 135/10* (2013.01); *C10M 141/10* (2013.01); *C10M 169/04* (2013.01); *C10M 2201/041* (2013.01); *C10M 2201/065* (2013.01); *C10M 2201/066* (2013.01); *C10M 2201/14* (2013.01); *C10M 2203/1006* (2013.01); *C10M 2203/1025* (2013.01); *C10M 2205/0285* (2013.01); *C10M 2205/173* (2013.01); *C10M 2207/40* (2013.01); *C10M 2207/401* (2013.01); *C10M 2209/104* (2013.01); *C10M 2209/109* (2013.01); *C10M 2219/044* (2013.01); *C10M 2219/089* (2013.01); *C10M 2223/043* (2013.01); *C10M 2223/049* (2013.01); *C10N 2210/01* (2013.01); *C10N 2210/02* (2013.01); *C10N 2210/03* (2013.01);

(Continued)

(58) Field of Classification Search
CPC combination set(s) only.
See application file for complete search history.

(56) References Cited

U.S. PATENT DOCUMENTS

2003/0111838 A1* 6/2003 Goto ..... C10M 111/04 285/94

* cited by examiner

*Primary Examiner* — Ellen M Mcavoy
*Assistant Examiner* — Chantel L Graham
(74) *Attorney, Agent, or Firm* — Tutunjian & Bitetto, P.C.

(57) ABSTRACT

An industrial lubricant composition including an oil base selected from the group consisting of vegetable oil, Group I, Group II, Group III, Group IV, Group V and combinations thereof and a phosphorus-based non-chlorine additive. The industrial lubricant also includes at least one intercalation compound of a metal chalcogenide, a carbon containing compound and a boron containing compound, wherein the intercalation compound may have a geometry that is a platelet shaped geometry, a spherical shaped geometry, a multi-layered fullerene-like geometry, a tubular-like geometry or a combination thereof.

15 Claims, 14 Drawing Sheets

Related U.S. Application Data

(60) Provisional application No. 62/189,254, filed on Jul. 7, 2015.

(51) Int. Cl.
*B21B 45/02* (2006.01)
*C10M 169/04* (2006.01)
*C10M 141/10* (2006.01)

(52) U.S. Cl.
CPC ..... *C10N 2210/04* (2013.01); *C10N 2210/06* (2013.01); *C10N 2210/07* (2013.01); *C10N 2220/082* (2013.01); *C10N 2220/086* (2013.01); *C10N 2230/06* (2013.01); *C10N 2240/40* (2013.01); *C10N 2240/401* (2013.01); *C10N 2240/402* (2013.01)

4-Ball Test-Extreme pressure test (last non-seizure load)
ASTM D2783; AISI 52100

INDUSTRIAL LUBRICANT INCLUDING METAL CHALCOGENIDE PARTICLES AND PHOSPHORUS-BASED ADDITIVE

CROSS REFERENCE TO RELATED APPLICATION

The present invention is a divisional application and claims the benefit of U.S. patent application Ser. No. 15/204,541 filed Jul. 7, 2016 the whole contents and disclosure of which is incorporated by reference as is fully set forth herein.

BACKGROUND

Technical Field

The present disclosure relates to industrial lubricants, and in some embodiments relates to lubricants used in metal working.

Description of the Related Art

Metalworking fluid (MWF) is the name given to a range of oils and other liquids that are used to cool and/or lubricate metal workpieces when they are being machined, ground, milled, etc. MWFs reduce the heat and friction between the cutting tool and the workpiece, and help prevent burning and smoking. Applying MWFs also helps improve the quality of the workpiece by continuously removing the fines, chips, and swarfs (Swarfs are the small pieces of metal removed from a workpiece by a cutting tool) from the tool being used and the surface of the workpiece.

SUMMARY OF THE INVENTION

In one embodiment, an industrial lubricant composition is provided that includes an oil base selected from the group consisting of vegetable oil, Group I type oil, Group II type oil, Group III type oil, Group IV type oil, Group V type oil and combinations thereof. In some examples, the oil base may be provided by a vegetable oil. The metal working lubricant also includes a phosphorus-based non-chlorine additive, and at least one intercalation compound of a metal chalcogenide, carbon containing compound or boron containing compound. The intercalation compound may have a geometry that is a platelet shaped geometry, a spherical shaped geometry, a multi-layered fullerene-like geometry, a tubular-like geometry or a combination thereof. Some examples of metal chalcogenide intercalation compounds can include tungsten disulfide ($WS_2$) and molybdenum disulfide ($MoS_2$). Some examples of carbon containing intercalation compounds include graphene and graphite, while an example of a boron containing intercalation compound may include boron nitride. In some examples, the industrial lubricant may be employed as a metal working fluid, gear oil, hydraulic oil, turbine oil or a combination thereof.

In another aspect of the present disclosure, the present disclosure provides a metal working method. The metal working method may include providing a metal substrate, and applying an industrial lubricant to the metal substrate. The metal substrate may be a preformed blank shape for threading, a metal sheet, a metal plate, or a combination thereof. The industrial lubricant may include an oil base, a phosphorus-based non-chlorine additive, and at least one intercalation compound of a metal chalcogenide, carbon containing compound, boron containing compound or combination thereof. The intercalation compound can have a multi-layered fullerene-like geometry, a tubular-like geometry or a combination of fullerene-like geometries and tubular-like geometries. Following the application of the industrial lubricant to the metal substrate, the metal substrate may be worked. Working may include cutting, chip, burning, drilling turning, milling, grinding, sawing, threading, filing, drawing, forming, necking, stamping, planning, rabbeting, routing, broaching or a combination thereof.

BRIEF DESCRIPTION OF THE DRAWINGS

The following detailed description, given by way of example and not intended to limit the disclosure solely thereto, will best be appreciated in conjunction with the accompanying drawings, wherein like reference numerals denote like elements and parts, in which.

DETAILED DESCRIPTION OF THE PREFERRED EMBODIMENTS

Figure 1:
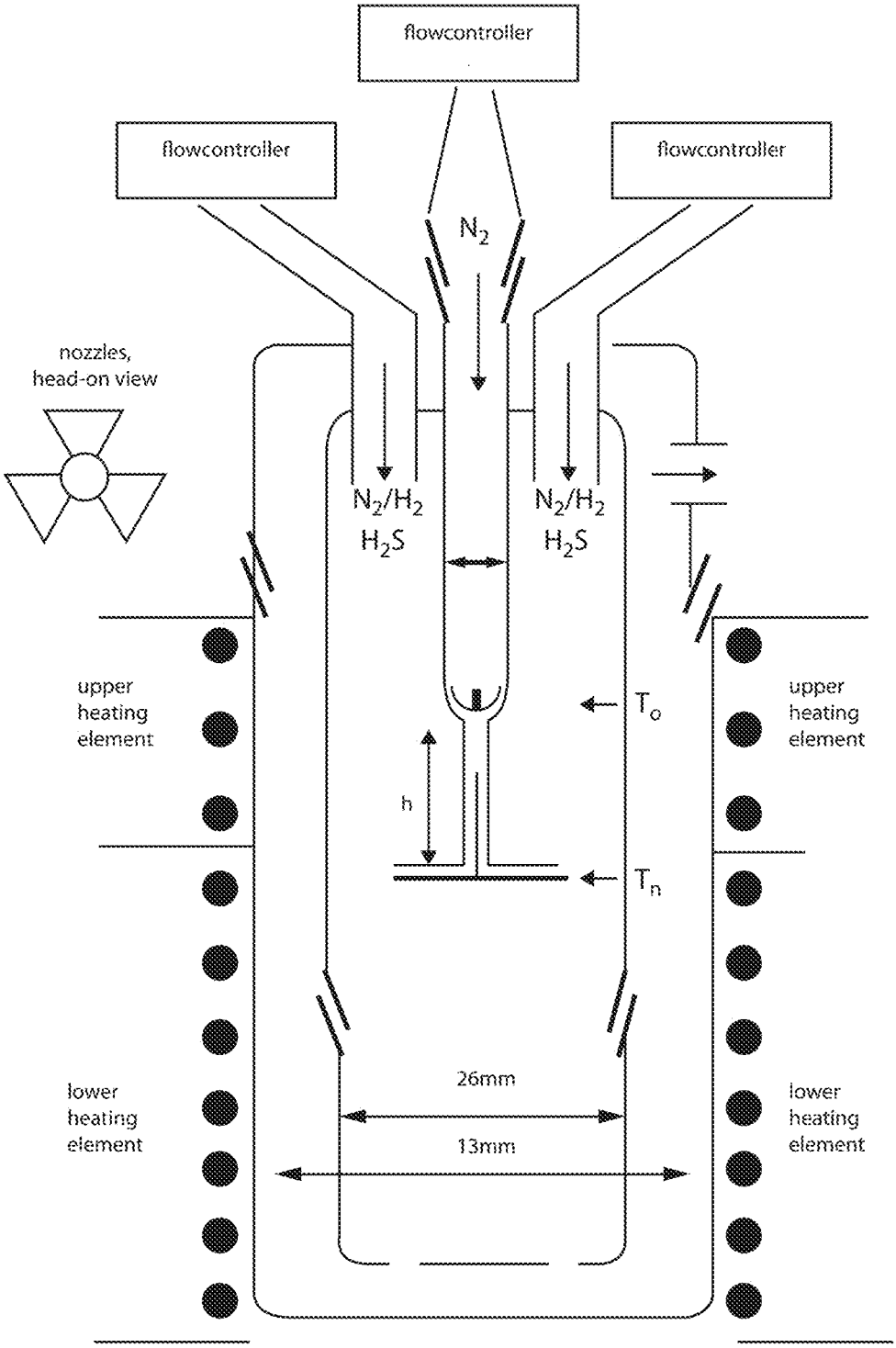
FIG. 1 is a schematic view illustrating one embodiment of chemical reactor for forming some examples of metal chalcogenide intercalation compounds, such as fullerene-like nanoparticles, in accordance with one embodiment of the present disclosure.

Detailed embodiments of the present disclosure are described herein; however, it is to be understood that the disclosed embodiments are merely illustrative of the compositions, structures and methods of the disclosure that may be embodied in various forms. In addition, each of the examples given in connection with the various embodiments are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the compositions, structures and methods disclosed herein. References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment.

In one embodiment, an industrial lubricant composition is provided that includes an oil base that in some examples may be provided by a vegetable oil, or petrochemical type oil, such as a Group I type oil, a Group II type oil, a Group III type oil, a Group IV type oil, a Group V type oil and combinations thereof. In some examples, the oil base may be provided by a vegetable oil. The industrial lubricant also includes a phosphorus-based non-chlorine additive, and at least one intercalation compound of a metal chalcogenide, carbon containing compound or boron containing compound. The intercalation compound may have a geometry that is a platelet shaped geometry, a spherical shaped geometry, a multi-layered fullerene-like geometry, a tubular-like geometry or a combination thereof. Some examples of metal chalcogenide intercalation compounds can include tungsten disulfide ($WS_2$) and molybdenum disulfide ($MoS_2$). Some examples of carbon containing intercalation compounds include graphene and graphite, while an example of a boron containing intercalation compound may include boron nitride. In some examples, the industrial lubricant may be employed as a metal working fluid, gear oil, hydraulic oil, turbine oil or a combination thereof.

The oil base of the industrial lubricant is an oil selected from the group consisting of vegetable oils, Group I type oils, Group II type oils, Group III type oils, Group IV type oils and Group V type oils. A "vegetable oil" is a triglyceride extracted from a plant. The term "vegetable oil" can include oils that are liquid at room temperature, or oils that are solid at room temperature are sometimes called vegetable fats. Vegetable oils are composed of triglycerides, as contrasted with waxes which lack glycerin in their structure. Most, but not all vegetable oils are extracted from the fruits or seeds of plants.

In some examples, vegetable oils that are suitable for the oil base of the industrial lubricant may be selected from the group consisting of canola oil, coconut oil, corn oil, cottonseed oil, olive oil, palm oil, peanut oil rapeseed oil, safflower oil, sesame oil, soybean oil, sunflower oil, almond oil, beech nut oil, cashew oil, hazelnut oil, macadamia oil, mongongo nut oil, pecan oil, pine nut oil, pistachio oil, walnut oil, grapefruit seed oil, lemon oil, orange oil, watermelon seed oil, bitter gourd oil, bottle gourd oil, buffalo gourd oil, butternut squash seed oil, egusi seed oil, pumpkin seed oil, blackcurrant seed oil, evening primrose oil, açaí oil, black seed oil, blackcurrant seed oil, borage seed oil, evening primrose oil, flaxseed oil, amaranth oil, apricot oil, apple seed oil, argan oil, avocado oil, babassu oil, ben oil, borneo tallow nut oil, cape chestnut oil, carob pod oil (algaroba oil), cocoa butter, *theobroma* oil, cocklebur oil, cohune oil, coriander seed oil, date seed oil, dika oil, false flax oil, grape seed oil, hemp oil, kapok seed oil, kenaf seed oil, lallemantia oil, mafura oil, mafura butter, marula oil, meadowfoam seed oil, mustard oil, *niger* seed oil, nutmeg butter, okra seed oil, *papaya* seed oil, *perilla* seed oil, persimmon seed oil, pequi oil, pili nut oil, pomegranate seed oil, poppyseed oil, prune kernel oil, *quinoa* oil, ramtil oil, rice bran oil, royle oil, sacha inchi oil, sapote oil, seje oil, shea butter, taramira oil, tea seed oil (*Camellia* oil), thistle oil, tigernut oil, tobacco seed oil, tomato seed oil, wheat germ oil, peppermint oil and combinations thereof.

In another embodiment, the oil component, i.e., fluid medium, of the industrial lubricant can be another type of biolubricant, e.g., an animal oil, such as whale oil.

In some examples, the vegetable/animal oils used for the base of the industrial lubricant may be methyl esters of fatty acids or triglycerides ($C_5$-$C_{22}$) derived from vegetable seeds or animal fats. The methyl esters of fatty acids or triglycerides can be derived synthetically or from natural products, such as lard, tallow, soybean oil, coconut oil, rapeseed (canola) oil, peanut oil, sunflower oil, or crambe oil. These natural oils typically contain $C_{16}$ palmitic acid, and $C_{18}$ stearic, oleic, linoleic, and linolenic. The methyl ester of a fatty acid may be a methyl ester of oleic, linoleic, linolenic, palmitic, or stearic acid, naturally derived or synthetically produced, or combination. It is apparent that producing the methyl esters of a fatty acid directly from heterogeneous natural oils is simpler and more economical than making pure methyl esters of individual fatty acids and the results are adequate. The term "methyl esters of a fatty acid" is therefore intended to encompass both heterogeneous preparations from natural oils and pure compositions.

In some examples, the base oil may be provided by methyl soyates (methyl ester of soybean oil), in which commercially available examples may include SoyGold by A.G. Environmental Products, preferably SoyGold 6000 and SoyGold 1000. Other examples of methyl esters of fatty acids or triglycerides include Oleocal ME-70, Oleocal ME-112, Oleocal ME-30, Erucical ME-106, products of Lambent Technologies; and FAME, fatty acid methyl ester, product of Cargill.

In some other embodiments, other oil types, such as petrochemical based oils, e.g., Group I, II, III and IV type oils, as well as Group V type oils may be suitable for the oil base of the industrial lubricant. When describing an oil bases using the terms "Group" and a roman numeral of, e.g., I-V, these terms are describing a type of oil composition as designated by the American Petroleum Institute (API). Group I base oils are classified as less than 90 percent saturates, greater than 0.03 percent sulfur (S) with a viscosity-index range of 80 to 120. In some embodiments, the temperature range for these oils is from 32 degrees F. to 150 degrees F. Group I base oils can be manufactured by solvent extraction, solvent or catalytic dewaxing, and hydro-finishing processes. Common Group I base oil may include 150SN (solvent neutral), 500SN, and 150BS (brightstock). Group I base oils are typically mineral oils.

Group II base oils are defined as being more than 90 percent saturates, less than 0.03 percent sulfur and with a viscosity index of 80 to 120. Group II base oils can be often manufactured by hydrocracking. Since all the hydrocarbon molecules of these oils are saturated, Group II base oils have better anti-oxidation properties than Group I base oils. Group II base oils are also typically mineral oils.

Group III base oils are defined as being greater than 90 percent saturates, less than 0.03 percent sulfur and have a viscosity index above 120. These oils are refined even more than Group II base oils and generally are hydrocracked with a higher pressure and heat than Group II. The processing for forming Group III base oils are typically longer than the processing for Group II base oils, and are designed to achieve a purer base oil. Although typically made from crude oil, Group III base oils are sometimes described as synthesized hydrocarbons. Group III base oils can be manufactured by processes, such as isohydromerization, and can be manufactured from base oil or slax wax from dewaxing process.

Group IV base oils are polyalphaolefins (PAOs). These synthetic base oils are made through a process called synthesizing. More specifically, in some embodiments, the process may begin with oligomerisation of alpha olefins and a catalyst. Oligomerization is followed by distillation. The oligomerization and distillation steps may include steam cracking hydrocarbons to produce ultra high-purity ethylene, ethylene oligomerization to develop 1-decene and 1-dodecene, and decene or dodecene oligomerization to form a mixture of dimers, trimers, tetramers and higher oligomers. Distillation is followed by hydrogenation including hydrogen and a catalyst. Group IV base oils, such as polyalphaolefins (PAOs), are suitable for a broader temperature range than Group I, II and III base oils, and are applicable for use in extreme cold conditions and high heat applications. Group IV base oils typically have a viscosity index of at least 140.

Group V base oils are classified as all other base oils, including silicone, phosphate ester, polyalkylene glycol (PAG), polyolester, biolubes, etc. These base oils are at times mixed with other base stocks, such as the aforementioned Group I, II, III and IV base oils. An example would be polyalphaolefin (PAO) that is mixed with a polyolester. Esters are common Group V base oils used in different lubricant formulations to improve the properties of the existing base oil. In some embodiments, ester oils can take more abuse at higher temperatures and will provide superior detergency compared to a polyalphaolefin (PAO) synthetic base oil, which in turn increases the hours of use. Examples of synthetic oils include olefins, isomerized olefins, synthetic esters, phosphate esters, silicate esters, polyalkylene glycols, etc.

In some embodiments, the oil base may be about 20% to 95% of the industrial lubricant by volume. In yet other embodiments, the oil base is in the amount of up to or about 30, 40, 50, 55, 60, 65, 75, 80, 85 or 90% of the composition. In some examples, the oil base provides up to or about 90% of the industrial lubricant.

The industrial lubricant may also include an extreme pressure (EP) additive. In some of the slow, highly loaded, geared applications, there exists a lubricating condition that is typical for most failures due to adhesive wear. This condition is known as a boundary condition. In a boundary condition, there is no separation of the interacting surfaces. The function of an extreme pressure (EP) additive is to prevent this adhesive wear and protect the components when the lubricating oil can no longer provide the necessary film thickness. Extreme pressure additives are polar molecules, e.g., a molecule having a head and a tail, wherein the head of the molecule can be attracted to the metal surface, while the tail is compatible with the lubricant carrier (oiliofilic), e.g., the oil base of the disclosed industrial lubricant. As the conditions under which metal-to metal interactions become more severe due to higher temperatures and pressures (greater loads), the lubricant film becomes more stressed. The distance between the metal surfaces has decreased to the point where rubbing is occurring and welding (adhesion) becomes highly likely. Temperature dependent EP additives can be activated by reacting with the metal surface when the temperatures are elevated due to the extreme pressure. The chemical reaction between the additive and metal surface is driven by the heat produced from friction. Some EP additives are temperature-dependent, while some EP additives are not. The most common temperature-dependent types include boron, chlorine, phosphorus and sulfur, which are suitable for use with some embodiments of the industrial lubricants disclosed herein.

The non-temperature-dependent EP additives, which are often based on sulfonate containing compositions, operate by a different mechanism that the temperature dependent EP additive compositions. A sulfonate is a salt or ester of a sulfonic acid, and contains the functional group R—$SO_2O$—. Anions with the general formula $RSO_2O$— are called sulfonates. For example, the non-temperature-dependent EP additives may contain a colloidal carbonate salt dispersed within the sulfonate. During the interaction with iron, the colloidal carbonate forms a film that can act as a barrier between metal surfaces, much like the temperature-dependent; however, it does not need the elevated temperatures to start the reaction. Reactions with non-temperature-dependent EP additives may function at room temperature, e.g., 20° C. to 25° C. Both temperature dependent and non-temperature dependent EP additives are suitable for use with the industrial lubricants that are disclosed herein.

In some embodiments, the industrial lubricant also includes a phosphorus-based non-chlorine additive, such as a polar non-chlorine extreme pressure additive is a sulfur-based, or phosphorus-based derivative, or a combination of sulfur-based and phosphorus-based compounds that is polar and sterically small enough to interact with the metal surface of a work piece together with the oil base, e.g., methyl ester, as well as the intercalation compound.

The term "phosphorous-based polar non-chlorine extreme pressure additive" means a phosphorus-based derivative, such as phosphorus-based amine phosphates, including alkylamine or alkanolamine salts of phosphoric acid, butylamine phosphates, long chain alkyl amine phosphates, organophosphites, propanolamine phosphates, or other hydrocarbon amine phosphates, including triethanol, monoethanol, dibutyl, dimethyl, and monoisopropanol amine phosphates. The phosphorus-based derivative may be an ester including thioesters or amides of phosphorous containing acids. The organic moiety from which the phosphorous compound is derived may be an alkyl, alcohol, phenol, thiol, thiophenol or amine. The three organic residues of the phosphate compound may be one or more of these or combinations. Alkyl groups with 1 to 4 carbon compounds are suitable. A total carbon content of 2 to 12 carbon atoms is suitable. In some embodiments, the phosphorous based compound may be a phosphorous oxide, phosphide, phosphite, phosphate, pyrophosphate and thiophosphate.

The polar non-chlorine extreme pressure additive may be a sulfur-based derivative such as sulfurized fatty esters, sulfurized hydrocarbons, sulfurized triglycerides, alkyl polysulfides and combinations.

The polar non-chlorine extreme pressure additive may be selected from the group consisting of Desilube 77, RheinChemie RC 8000 and RheinChemie RC2540, RheinChemie 2515, RheinChemie 2526, Lubrizol 5340L, Nonyl Polysulfide, Vanlube 672, Rhodia Lubrhophos LL-550, or EICO 670 or combinations. In some embodiments, the polar non-chlorine extreme pressure additive is an amine phosphate blend, such as the commercially available product, Desilube™ 77 Lubricant Additive by Desilube Technology, Inc., a mixture of organic amine salts of phosphoric and fatty acids.

In some embodiments, the composition of the industrial lubricant provided herein may be composed of from about 2% to 30% polar non-chlorine extreme pressure additive. In some examples, the polar non-chlorine extreme pressure additive is in the amount of up to or about 0.5%, 1%, 2%, 3%, 5%, 10%, 15%, or 20% of the composition. In further examples, the polar no-chlorine extreme pressure additive may be present in an amount equal to 1%, 5%, 10%, 15%, 20%, 25%, and 30%, and any range including an upper limit value and a maximum limit value provided by any of the above examples. The ratio of the base oil to the polar non-chlorine extreme pressure additive is in the range of about 1:1.5 to about 48:1.

The industrial lubricant also includes at least one intercalation compound of a metal chalcogenide, carbon containing compound or boron containing compound. The term "intercalation compound" denotes a compound that can be inserted between elements or layers. The intercalation compound typically has a fullerene-like or tube-like geometry, but may also have a platelet like geometry. The intercalation compound may have a geometry that is a platelet shaped geometry, a spherical shaped geometry, a multi-layered fullerene-like geometry, a tubular-like geometry or a combination thereof. Some examples of metal chalcogenide intercalation compounds can include tungsten disulfide ($WS_2$) and molybdenum disulfide ($MoS_2$). Some examples of carbon containing intercalation compounds include graphene and graphite, while an example of a boron containing intercalation compound may include boron nitride.

As used herein, the term "fullerene-like" denotes a substantially spherical geometry. In some instances, the fullerene-like structures may be perfectly spherical, i.e., having the form of a sphere. The spherical nature of the metal chalcogenide fullerene-like structures provided herein is distinguished from metal chalcogenide nanostructures that may be oblong, oval (e.g., open ended oval), football shaped, columnar shaped, plate-like shaped, or any irregularly shaped particle that deviates from being spherical which typically results from a method of reducing particle size physically, such as milling of particles from the macro and micron scale to the nanometer scale. Or the milling of particles from a larger nanoscale size to a less nanoscale size.

The spherical nature of the metal chalcogenide composition fullerene-like structures provided by the present disclosure results from being synthesized within the nano-sized regime using chemical methods. For example, synthesis of inorganic fullerene-like molybdenum disulfide (IF-$MoS_2$) may be based upon the sulfidization of amorphous $MO_3$, e.g., $MO_3$ thin films, in a reducing atmosphere at elevated temperatures (e.g., ~850° C.). It is noted, that the metal chalcogenide IFs, such as IF-$MoS_2$, can also be synthesized using high-temperature methods that occur above 650° C. These methods typically involve such techniques as growth from gas phase, e.g., in which $MoO_3$ in the vapor phase is reached with $H_2S$ in a carrier, as employed in the apparatus depicted in FIG. 1. One embodiment, of the process that may be consistent with the apparatus depicted in FIG. 1 includes the use of $MoO_3$ powder placed in the inner part of the reactor (a) which can be heated to a temperature of approximately 780° C. Molecular clusters $(MoO_3)_3$ can be formed and carried down through the reactor by $N_2$ gas. Hydrogen gas diffuses through the nozzles (c) from the outer reactor (b) and starts to react with the molecular clusters. The mild reduction conditions yield reduced $MoO_3$ clusters, which are less volatile, and form $MoO_3$ nanosize particles at the low part of (a). The suboxide nanoparticles reach a size less than 5 nm before the sulfidization step. The coated oxide nanoparticles are swept by the carrier gas outside the reactor (a). Because the nanoparticles are surface-passivated, they land on the ceramic filter (d) and the oxide-to-sulfide conversion continues within the core without coalescence of the nanoparticles. The gas-phase reactor synthesis process generates pure IF-$MoS_2$ phase, and can control the size and shape of the nanoparticles. In other embodiments, inorganic materials having the metal chalcogenide composition, e.g., $WS_2$, and the fullerene-like geometry and/or tubular-like geometry may be produced via sulfidization of tungsten oxide nanoparticles in reduction atmosphere in fluidized bed reactor.

The inorganic materials having the metal chalcogenide composition and the fullerene-like geometry and/or tubular-like geometry may also be formed in accordance with at least one of the methods disclosed in U.S. Patent Application Publication No. 2006/0120947, U.S. Pat. Nos. 7,524,481, 6,217,843, 7,641,869, U.S. Patent Application Publication No. 2010/0172823, U.S. Pat. Nos. 6,710,020, 6,841,142, 7,018,606, 8,513,364, 8,329,138, 7,959,891, 7,018,606, U.S. Patent Application Publication No. 2013/0109601, U.S. Patent Application Publication No. 2010/0227782 and U.S. Pat. No. 7,641,886, which are each incorporated herein in their entirety. The inorganic materials having the metal chalcogenide composition and the fullerene-like geometry and/or tubular-like geometry formed using the methods within the scope of the above provided description can have a very small particle size distribution. It is noted that the methods disclosed in the aforementioned patents are only some examples of methods that are suitable for forming the inorganic materials having the metal chalcogenide composition and the fullerene-like and/or tubular-like geometry. Any method may be employed for forming the above-described inorganic materials having the metal chalcogenide composition, so long as the compound formed has a fullerene-like and/or tubular-like geometry.

Figure 2:
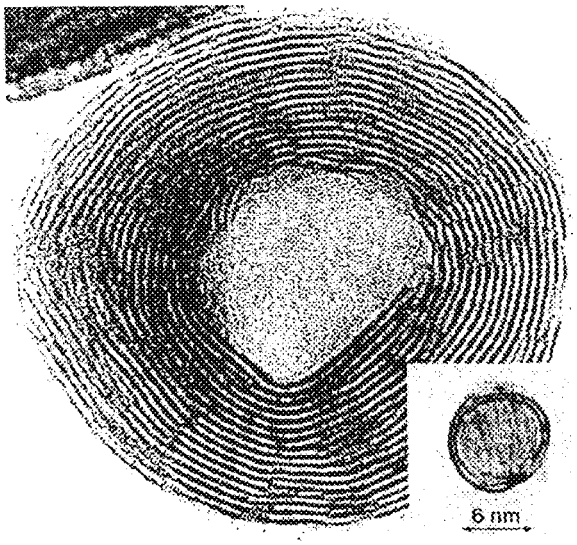
FIG. 2 is a transmission electron microscope (TEM) images of a metal chalcogenide intercalation compound having a molecular formula $MX_2$ and a fullerene-like geometry that is spherical, in accordance with one embodiment of the present disclosure.
Figure 3:
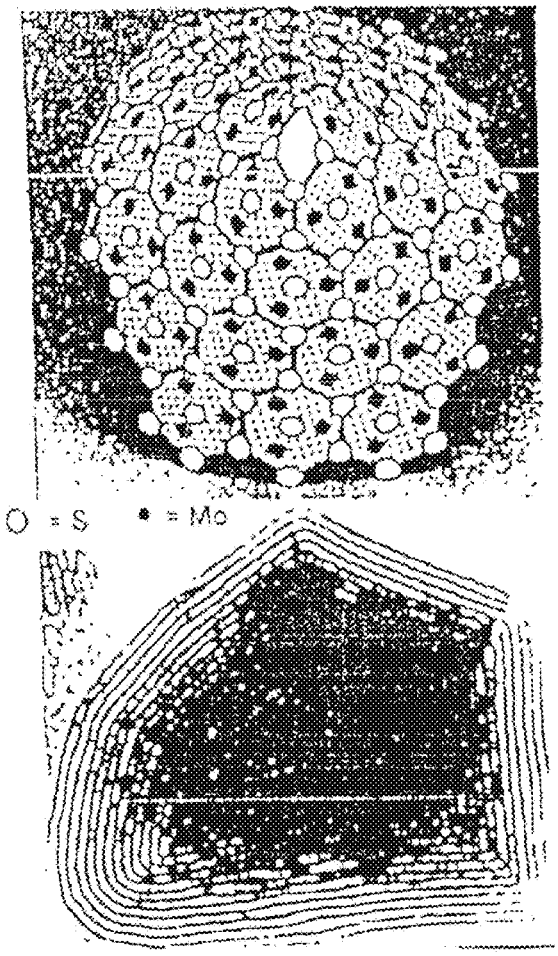
FIG. 3 is an illustration of the chemical structure of a fullerene-like $MoS_2$ nanoparticle, in accordance with one embodiment of the present disclosure.

A characteristic image of IF nanoparticles produced in the gas-phase reactor that has been described above is illustrated in FIGS. 2 and 3. FIG. 2 depicts one embodiment of a fullerene-like structures may be perfectly spherical, in accordance with the present disclosure. FIG. 3 is an illustration of the chemical structure of a fullerene-like $MoS_2$ nanoparticle, which is a cage like spherical geometry of molybdenum identified by black circles and sulfur identified by white circles. FIG. 3 illustrates that the inorganic metal chalcogenide having the caged substantially spherical structure is similar to the caged structure of carbon 60 illustrating a fullerene like arrangement. As discussed above, the fullerene-like structures of metal chalcogenide may be perfectly spherical. The particles obtained by the present disclosure can have a more perfect spherical shape, than those obtained by the conventional synthetic tools. This stems from the fact that, according to some embodiments of the present disclosure, the reaction takes place in the gas phase, where an isotropic environment for the reaction prevails. Consequently, much larger oxide nanoparticles could be converted into IF when they flow in the gas stream.

The core of the fullerene-like geometry may be hollow, solid, amorphous, or a combination of hollow, solid and amorphous portions. A fullerene like geometry may also be referred to as having a cage geometry. In one example, an inorganic material having the metal chalcogenide composition with a fullerene like geometry may be a cage geometry that is hollow at its core and layered at is periphery. In another example, an inorganic material having the metal chalcogenide composition with a fullerene like geometry may be a cage geometry that is solid at its core and layered at is periphery. For example, the inorganic material having the metal chalcogenide composition and the fullerene like geometry may be a single layer or double layered structure. The inorganic material having the metal chalcogenide composition and the fullerene like geometry is not limited on only single layer or double layered structures, as the inorganic material may have any number of layers. For example, the metal chalcogenide composition may be layered to include 5 layers to 100 layers of metal chalcogenide material that can exfoliate from the particle. In another embodiment, the metal chalcogenide composition may be layered to include 10 layers to 50 layers of metal chalcogenide material that can exfoliate from the particle. In yet another embodiment, the metal chalcogenide composition may be layered to include 15 layers to 20 layers of metal chalcogenide material that can exfoliate from the particle. These structures are also referred to in the art as being "nested layer structures".

One example of an inorganic material having the metal chalcogenide composition and the fullerene like geometry fullerene-like geometry is depicted in FIGS. 2-3. FIG. 2 depicts a transmission electron microscope (TEM) image of an inorganic material having a tungsten disulfide ($WS_2$) composition with a fullerene-like geometry. In another example, the inorganic material having the metal chalcogenide composition and the inorganic fullerene like geometry is composed of molybdenum disulfide ($MoS_2$). It is noted that the inorganic material with the fullerene-like geometry that is depicted in FIG. 2 is not limited to only tungsten disulfide ($WS_2$) and molybdenum disulfide ($MoS_2$). Inorganic materials with a metal chalcogenide composition and having a fullerene-like geometry may have any inorganic composition that meets the formula $MX_2$, where M is a metallic element selected from the group consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), mercury (Rg) and combinations thereof, and X is a chalcogen element selected from the group consisting of sulfur (S), selenium (Se), tellurium (Te), oxygen (O) and combinations thereof.

The inorganic material having the metal chalcogenide composition and fullerene-like geometry may have a diameter ranging from 1 nm to 15 microns. In another embodiment, the inorganic material having the metal chalcogenide composition and the fullerene-like geometry may have a diameter ranging from 2 nm to 10 microns. In yet another embodiment, the inorganic material having the metal chalcogenide composition and the fullerene-like geometry may have a diameter ranging from 5 nm to 5 microns. The inorganic material having the metal chalcogenide composition and the fullerene-like geometry may have a diameter that is any value within the above ranges. It is noted that the above dimensions are provided for illustrative purposes only, and are not intended to limit the present disclosure. In some embodiments, most of the nanoparticles will have diameters ranging between 20 nm to 500 nm, and even more typically will have diameters between 30 nm to 200 nm. The above described particles may be referred to as "fullerene-like geometry without a sectioned outer layer".

The component of the coating that is provided by the inorganic material of the metal chalcogenide composition may also have tubular-like geometry. As used herein, the term "tubular-like geometry" denotes a columnar or cylindrical geometry, in which one axis of the intercalation compound. In some embodiments, an inorganic material having the metal chalcogenide composition and the tubular-like geometry may be a cage geometry that is hollow at its core and layered at its periphery. In other embodiments, an inorganic material having the metal chalcogenide composition and the tubular-like geometry may be a cage geometry that is solid at its core, and/or amorphous at its core, and layered at its periphery. For example, the inorganic material having the metal chalcogenide composition and the tubular-like geometry may be a single layer or double layered structure. These structures are also referred to in the art as being "nested layer structures". The number of layers in the inorganic material having the metal chalcogenide composition and the tubular-like geometry may be similar to the number of layers in the inorganic material having the metal chalcogenide composition and the fullerene-like geometry. In some examples, the minimum number of layers for the inorganic material having the tubular-like geometry is approximately 4 layers.

Figure 4:
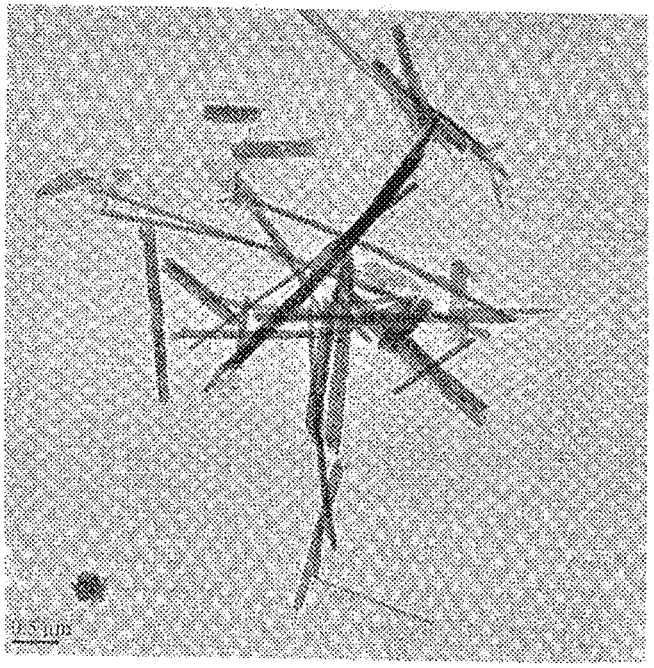
FIG. 4 is a transmission electron microscope (TEM) image of a metal chalcogenide intercalation compound having a molecular formula $MX_2$ and a tubular-like geometry, in accordance with one embodiment of the present disclosure.

One example of an inorganic material having the metal chalcogenide composition and the tubular-like geometry is depicted in FIG. 4. FIG. 4 depicts a transmission electron microscope (TEM) image of an intercalation compound having a tungsten disulfide ($WS_2$) composition with an inorganic tubular-like geometry. In another example, the inorganic material having the metal chalcogenide composition and the tubular-like geometry is composed of molybdenum disulfide ($MoS_2$). It is noted that the inorganic material having the metal chalcogenide composition and the tubular-like geometry that is depicted in FIG. 4 is not limited to only tungsten disulfide ($WS_2$) and molybdenum disulfide ($MoS_2$). Inorganic materials having a tubular-like geometry may have any inorganic composition that meets the formula $MX_2$, where M is a metallic element selected from the group consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), mercury (Hg), and combinations thereof, and X is a chalcogen element selected from the group consisting of sulfur (S), selenium (Se), tellurium (Te) and oxygen (O).

The inorganic materials having the metal chalcogenide composition and the tubular-like geometry may have a diameter, i.e., distance perpendicular to the greatest axis of the tubular-like geometry, ranging from 1 nm to 300 nm. In another embodiment, the inorganic materials having the metal chalcogenide composition and the tubular-like geometry may have a diameter ranging from 5 nm to 125 nm. In yet another embodiment, the inorganic materials have the metal chalcogenide composition and the tubular-like geometry with a diameter ranging from 10 nm to 100 nm. The inorganic materials having the metal chalcogenide composition and the tubular-like geometry may have a length, i.e., greatest axis of the tubular-like geometry, that ranges from 1 nm to 20 cm. In another embodiment, the inorganic materials having the metal chalcogenide composition and the tubular-like geometry may have a length, i.e., greatest axis of the tubular-like geometry, that ranges from 5 nm to 15 cm. In yet another embodiment, the inorganic materials having the metal chalcogenide composition and the tubular-like geometry may have a length, i.e., greatest axis of the tubular-like geometry, that ranges from 100 nm to 10 cm. The inorganic materials having the metal chalcogenide composition and the tubular-like geometry may have a length or diameter that is any value within the above ranges. It is noted that the above dimensions are provided for illustrative purposes only, and are not intended to limit the present disclosure.

Figure 5:
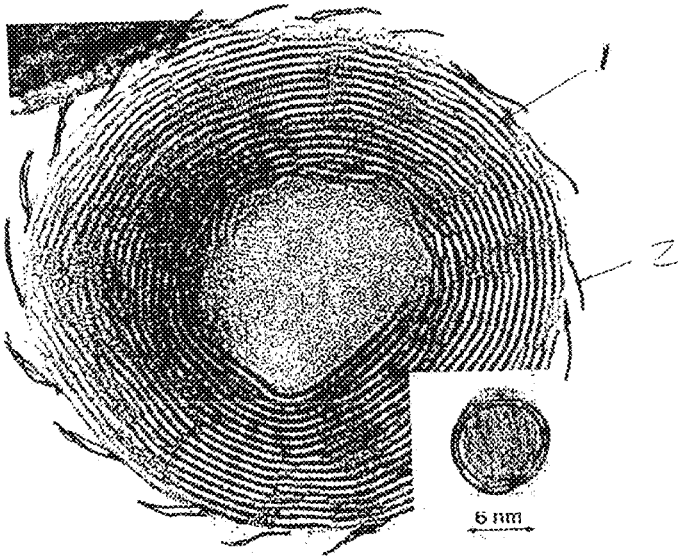
FIG. 5 is a transmission electron microscope (TEM) images of a metal chalcogenide intercalation compound having a molecular formula $MX_2$ and a fullerene-like geometry, wherein an outer layer of the multi-layered fullerene-like geometry is of nanoparticle dimension and comprises at least one sectioned portion, in which the sectioned portion may extend along a direction away from the curvature of nanoparticle, in accordance with one embodiment of the present disclosure.

FIG. 5 depicts a metal chalcogenide intercalation compound having a molecular formula $MX_2$ and a fullerene-like geometry, wherein an outer layer of the multi-layered fullerene-like geometry is of nanoparticle dimension and comprises at least one sectioned portion 2, in which the sectioned portion 2 may extend along a direction away from the curvature of nanoparticle. FIG. 5 depicts one embodiment of a multi-layered fullerene-like nano-structure comprising a plurality of layers 1 each comprised of an metal chalcogenide composition has a molecular formula of $MX_2$, where M is a metallic element selected from the group consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), mercury (Hg) and combinations thereof, and X is a chalcogen element selected from the group consisting of sulfur (S), selenium (Se), tellurium (Te), oxygen (O) and combinations thereof. Two example compositions for the structure depicted in FIG. 5 include $MoS_2$ and $WS_2$. An outer layer of the multi-layered fullerene-like structure comprises at least one sectioned portion 2. The at least one sectioned portion 2 extends along a direction away from the curvature of the multi-layered fullerene-like nano-structure. The at least one sectioned portion 2 is engaged to remaining section of the outer layer.

The multi-layered fullerene-like nano-structure can be substantially spherical, and in some instances may include layers that are perfectly spherical. The core of the multi-layered fullerene-like nano-structure having the sectioned outer layer may be hollow, solid, amorphous, or a combination of hollow, solid and amorphous portions. In some embodiments, the at least one sectioned portion 2 that extends along a direction away from the curvature of the multi-layered fullerene-like nano-structure extends along a direction that is tangent to the curvature surface of the multi-layered fullerene-like nano-structure. The at least one sectioned portion 2 that extends along a direction away from the curvature of the multi-layered fullerene-like nano-structure may extends along a direction that can be close to being substantially normal to the curvature surface of the multi-layered fullerene-like nano-structure.

The inorganic material having the metal chalcogenide composition and the fullerene like geometry with the sectioned outer layer is not limited on only single layer or double layered structures, as the inorganic material may have any number of layers. For example, the metal chalcogenide composition may be layered to include 5 layers to 100 layers of metal chalcogenide material that can exfoliate from the particle. In another embodiment, the metal chalcogenide composition may be layered to include 10 layers to 50 layers of metal chalcogenide material that can exfoliate from the particle. In yet another embodiment, the metal chalcogenide composition may be layered to include 15 layers to 20 layers of metal chalcogenide material that can exfoliate from the particle. These structures are also referred to in the art as being "nested layer structures".

The inorganic material having the metal chalcogenide composition and fullerene-like geometry with sectioned outer layer as depicted in FIG. 5 may have a diameter ranging from 1 nm to 15 microns. In another embodiment, the inorganic material having the metal chalcogenide composition and the fullerene-like geometry may have a diameter ranging from 2 nm to 10 microns. In yet another embodiment, the inorganic material having the metal chalcogenide composition and the fullerene-like geometry with sectioned outer layer, as depicted in FIG. 5, may have a diameter ranging from 5 nm to 5 microns. The inorganic material having the metal chalcogenide composition and the fullerene-like geometry may have a diameter that is any value within the above ranges. It is noted that the above dimensions are provided for illustrative purposes only, and are not intended to limit the present disclosure. In some embodiments, most of the nanoparticles will have diameters ranging between 20 nm to 500 nm, and even more typically will have diameters between 30 nm to 200 nm.

The sectioned portions of the outer layer may be present around an entire outer surface of the substantially spherical nanoparticle. The outer layer including the plurality of sectioned portions comprises dangled bonds that provide a charged surface of the outer layer of the multi-layered fullerene-like nano-structure. In one embodiment, the section portions 2 of the outer layer have a length ranging from 1% to 80% of a diameter of the multi-layered fullerene-like nano-structure, e.g., 1% to 70% of the multi-layered fullerene-like nano-structure.

In some embodiments, the outer layer of the multi-layered fullerene-like nano-structure is functionalized with a functionalizing agents selected from the group consisting of silanes, thiols, ionic, anionic, cationic, nonionic surfactants, amine based dispersant and surfactants, succinimide groups, fatty acids, acrylic polymers, copolymers, polymers, monomers and combinations thereof. Any of the functionalizing agents described in this paper are suitable for use with the multi-layered fullerene-like nano-structure having the sectioned outer layer.

Although, fullerenes structures have been specifically described, metal chalcogenides tube-like structures having an outer layer that includes at least one sectioned portion is within the scope of the present disclosure. For example, the at least one sectioned portion of the outer layer of the multilayered tube-like structure of metal chalcogenide may extend along a direction away from the curvature of the multi-layered tube-like nano-structure, the at least one sectioned portion engaged to remaining section of the outer layer.

The multi-layered fullerene-like structure comprises at least one sectioned portion that is depicted in FIG. 5 may be formed beginning with the multilayered fullerene like structures that are formed using the methods described above for forming the substantially spherical fullerene-like. Beginning with a multi-layered fullerene-like structure that does not include a sectioned outer layer, a force is applied to open up sections in the outer layer, which peels a portion of the outer layer from the curvature of the multi-layered fullerene-like structure. The force may be applied using any means to apply a physical force to the particles, such as milling, e.g., dry and/or wet milting, sonification, ultrasonication, and combinations thereof. The time and force is dependent upon the degree of sectioning preferred in the outer layer.

The sectioned outer layer provides a charged surface for the nanoparticle. The charged surface that results from the sectioned outer layer facilitates grafting of functional groups onto the multi-layered fullerene-like structure, which can be used to control rheology of dispersions and mixtures including the multi-layered fullerene-like structure having the sectioned outer layer. For example, the functionalized sectioned outer layer may allow for the multi-layered fullerene-like structure to be dispersed more easily than multi-layered fullerene-like structures that do not include the sectioned outer layer. Further, the sectioned outer layer can allow for layers of metal chalcogenide to be exfoliated in response to lower pressures and forces in lubrication of frictional surfaces, and repair of frictional surfaces in comparison to multi-layered fullerene-like structure that do not include the sectioned outer layer.

Figure 6:
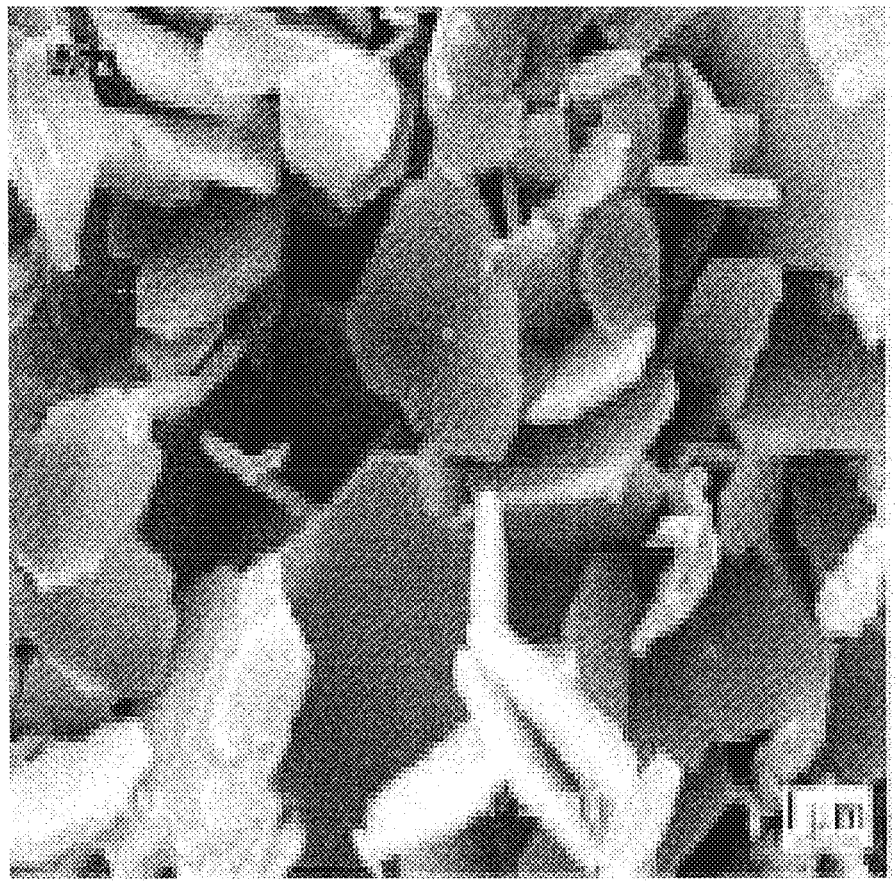
FIG. 6 is a transmission electron microscope (TEM) image of a metal chalcogenide having a molecular formula $MX_2$ and a platelet like geometry, in accordance with one embodiment of the present disclosure.

In addition to the above describe fullerene like and tubular like structures, the intercalation compound of metal chalcogenide that is employed in the industrial lubricant may also have a platelet like geometry. The term "platelet like" denotes a disc like shape that has a thickness dimension (z-direction) that is substantially less than the width (x-direction) and height dimension (y-direction). FIG. 6 is a transmission electron microscope (TEM) image of a metal chalcogenide having a molecular formula $MX_2$ and a platelet like geometry. In some examples, the metal chalcogenide having the platelet like geometry is composed of tungsten disulfide ($WS_2$) and/or molybdenum disulfide ($MoS_2$). It is noted that the inorganic material having the metal chalcogenide composition and the plate-like geometry that is depicted in FIG. 6 is not limited to only tungsten disulfide ($WS_2$) and molybdenum disulfide ($MoS_2$). Inorganic materials having a tubular-like geometry may have any inorganic composition that meets the formula $MX_2$, where M is a metallic element selected from the group consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Jr), platinum (Pt), gold (Au), mercury (Hg), and combinations thereof, and X is a chalcogen element selected from the group consisting of sulfur(S), selenium (Se), tellurium (Te) and oxygen (O). In some examples, when the intercalation compound is a nanoparticles having a platelet geometry, the platelet may have a width ranging from 5 nm to 990 nm, and a height ranging from 5 nm to 990 nm. In another example, when the intercalation compound is a micro scale particle, the platelet geometry may have a width ranging from 1 micron to 5 microns, a height ranging from 1 micron to 5 microns, and may have a thickness ranging from 10 nm to 1 micron.

The metal chalcogenide having the multi-layered fullerene-like structure, tubular-like structure, platelet like geometry or combination thereof is present in the industrial lubricant in amount of up to or about 0.5%, 1%, 2%, 3%, 5%, 10%, 15%, or 20% of the composition. In further examples, the multi-layered fullerene-like structure, tubular-like structure, platelet like geometry or combination thereof may be present in an amount equal to 1%, 5%, 10%, 15%, 20%, 25%, and 30%, and any range including an upper limit value and a maximum limit value provided by any of the above examples. The ratio of the base oil to the multi-layered fullerene-like structure, tubular-like structure, platelet like geometry or combination thereof is in the range of about 1:1.5 to about 48:1.

The surface of the inorganic fullerene-like and/or tube-like particles having the metal chalcogenide molecular formula $MX_2$ may be functionalized or modified by forming an adsorption-solvate protective layer on the particle surfaces, i.e., surface of the inorganic fullerene-like and/or tube-like particles having the molecular formula $MX_2$, and preventing the close approach and coagulation of particles under the action of short-range forces of molecular attraction. The close approach of particles may be impeded by the disjoining pressure of the liquid dispersion medium, i.e., base oil composition, which can be solvated by molecules or ions of the stabilizer in the adsorption layer, by electrostatic repulsion of like-charged ions adsorbed on the particle surfaces, or by enhanced structural viscosity of the surface protective layer, which can also be referred to as being a structural-mechanical barrier.

Surface functionalization for the surface of the inorganic fullerene-like and/or tube-like metal chalcogenide particles having the molecular formula $MX_2$ may be provided by functionalizing agents that include silanes, thiols, ionic, anionic, cationic, nonionic surfactants, amine based dispersant and surfactants, succinimide groups, fatty acids, acrylic polymers, copolymers, polymers, monomers and combinations thereof.

In some embodiments, the functionalizing agents can be described as comprising a headgroup (a part that interacts primarily with the surface of the inorganic fullerene-like and/or tube-like particles having the molecular formula $MX_2$) and a tailgroup (a part that interacts with the solvent, i.e., fluid medium). Useful headgroups include those that comprise alkoxy, hydroxyl, halo, thiol, silanol, amino, ammonium, phosphate, phosphonate, phosphonic acid, phosphinate, phosphinic acid, phosphine oxide, sulfate, sulfonate, sulfonic acid, sulfinate, carboxylate, carboxylic acid, carbonate, boronate, stannate, hydroxamic acid, and/or like moieties. Multiple headgroups can extend from the same tailgroup, as in the case of 2-dodecylsuccinic acid and (1-aminooctyl) phosphonic acid. Useful hydrophobic and/or hydrophilic tailgroups include those that comprise single or multiple alkyl, aryl, cycloalkyl, cycloalkenyl, haloalkyl, oligo-ethylene glycol, oligo-ethyleneimine, dialkyl ether, dialkyl thioether, aminoalkyl, and/or like moieties. Multiple tailgroups can extend from the same headgroup, as in the case of trioctylphosphine oxide.

Examples of silanes that are suitable for use as functionalizing agents with the inorganic fullerene-like and/or tube-like particles having the metal chalcogenide molecular formula $MX_2$ and the fluid medium, i.e., base oil compositions, of the present disclosure include organosilanes including, e.g., alkylchlorosilanes, alkoxysilanes, e.g., methyltrimethoxysilane, methyltriethoxysilane, ethyltrimethoxysilane, ethyltriethoxysilane, n-propyltrimethoxysilane, n-propyltriethoxysilane, i-propyltrimethoxysilane, ipropyltriethoxysilane, butyltrimethoxysilane, butyltriethoxysilane, hexyltrimethoxysilane, octyltrimethoxysilane, 3-mercaptopropyltrimethoxysilane, n-octyltriethoxysilane, phenyltriethoxysilane, polytriethoxysilane, vinyltrimethoxysilane, vinyldimethylethoxysilane, vinylmethyldiacetoxysilane, vinylmethyldiethoxysilane, vinyltriacetoxysilane, vinyltriethoxysilane, vinyltriisopropoxysilane, vinyltrimethoxysilane, vinyltriphenoxysilane, vinyltri(t-butoxy) silane, vinyltris(isobutoxy)silane, vinyltris (isopropenoxy) silane, and vinyltris (2-methoxyethoxy) silane; trialkoxyarylsilanes; isooctyltrimethoxy-silane; N-(3-triethoxysilylpropy-1) methoxyethoxyethoxy ethyl carbamate; N-(3-triethoxysilylpropyl) methoxyethoxyethoxyethyl carbamate; silane functional (meth)acrylates including, e.g., 3-(methacryloyloxy)propyltrimethoxysilane, 3-acryloyloxypropyltrimethoxysilane, 3-(methacryloyloxy)propyltriethoxysilane, 3-(methacryloyloxy)propylmethyldimethoxysilane, 3-(acryloyloxypropyl) methyldimethoxysilane, 3-(methacryloyloxy) propyldime-thylethoxysilane, 3-(methacryloyloxy) methyltriethoxysilane, 3-(methacryloyloxy) methyltrimethoxysilane, 3-(methacryloyloxy) propyldimet-hylethoxysilane, 3-methacryloyloxy) propenyltrimethoxysilane, and 3-(methacryloyloxy) propyltrimethoxysilane; polydialkylsiloxanes including, e.g., polydimethylsiloxane, arylsilanes including, e.g., substituted and unsubstituted arylsilanes, alkylsilanes including, e.g., substituted and unsubstituted alkyl silanes including, e.g., methoxy and hydroxy substituted alkyl silanes, and combinations thereof.

Examples of amines that are suitable for use as functionalizing agents with the inorganic fullerene-like and/or tube-like particles having the molecular formula $MX_2$ and the fluid medium of the present disclosure include alkylamines including, e.g., octylamine, oleylamine, decylamine, dodecylamine, octadecylamine, monopolyethylene glycol amines, and combinations thereof.

Useful organic acid functionalizing agents include, e.g., oxyacids of carbon (e.g., carboxylic acid), sulfur and phosphorus, and combinations thereof.

Representative examples of polar functionalizing agents having carboxylic acid functionality include $CH_3O(CH_2CH_2O)_2C—H_2COOH$ (hereafter MEEAA) and 2-(2-methoxyethoxy) acetic acid having the chemical structure $CH_3OCH_2CH_2OCH_2COOH$ hereafter MEAA) and mono (polyethylene glycol) succinate in either acid or salt forms.

Representative examples of non-polar functionalizing agents having carboxylic acid functionality include octanoic acid, dodecanoic acid and oleic acid.

Examples of suitable phosphorus containing acids that are suitable as functionalizing agents include phosphonic acids including, e.g., octylphosphonic acid, laurylphosphonic acid, decylphosphonic acid, dodecylphosphonic acid, octadecylphosphonic acid, and monopolyethylene glycol phosphonate in either acid or salt forms.

Examples of other useful functionalizing agents include acrylic acid, methacrylic acid, beta-carboxyethyl acrylate, mono-2-(methacryloyloxyethyl) succinate, and combinations thereof. A useful surface modifying agent is mono (methacryloyloxypolyethyleneglycol-) succinate.

Examples of suitable alcohols for functionalizing agents include, e.g., aliphatic alcohols including, e.g., octadecyl, dodecyl, lauryl and furfuryl alcohol, alicyclic alcohols including, e.g., cyclohexanol, and aromatic alcohols including, e.g., phenol and benzyl alcohol, and combinations thereof.

In some embodiments, the functionalizing agents may be introduced to the inorganic fullerene-like and/or tube-like particles having the molecular formula $MX_2$ during their formation prior to having the opportunity to agglomerate or destabilize from solution. In other embodiments, agglomerates of the inorganic fullerene-like and/or tube-like particles having the molecular formula $MX_2$ are first mechanically broken down into their primary size, i.e., the size of the primary particles prior to agglomeration. The mechanical reduction of the agglomerates of the inorganic fullerene-like and/or tube-like particles having the molecular formula $MX_2$ to their primary size may be referred to as milling.

In some embodiments inorganic fullerene nanoparticles can be mixed with other solid particles, which may be from 1 nm to10 microns in size, such as carbon fullerenes, carbon nanotubes, graphite, 2H—$MoS_2$, 2H—$WS_2$, boron, Zn, Cu, silver, graphite, MgOH, carbon diamond or combinations of thereof.

In some embodiments, the milling process may begin with agglomerates having a particle size ranging from 5 microns to 20 microns. The particles size of the agglomerates may be reduced using a high-shear mixer, two or three roll mixers, homogenizers, bead mills, ultrasonic pulverizer and a combination thereof. A high-shear mixer disperses, or transports, one phase or ingredient (liquid, solid, gas) into a main continuous phase (liquid), with which it would normally be immiscible. A rotor or impellor, together with a stationary component known as a stator, or an array of rotors and stators, is used either in a tank containing the solution to be mixed, or in a pipe through which the solution passes, to create shear. In some embodiments, the high shear mixer may be a batch high-shear mixers, an inline powder induction, a high-shear granulator, an ultra-high-shear inline mixers and a combinations thereof.

Other means for reducing the particle size of the agglomerates to the primary particle size of the inorganic fullerene-like and/or tube-like particles having the molecular formula $MX_2$ include an attritor, agitator, ball mill, bead mill, basket mill, colloid mill, high speed disperser, edge runner, jar mill, low speed paddle mixer, variable speed mixer, paste mixer, ribbon blender, pug mixer, nauta mixer, sand/perl mill, triple roll mill, two roll mill, planetary mixer, slow speed mixer, high speed mixer, twin shaft mixer, multi shaft mixer, sigma kneader, rotor-stator mixer, homogenizer/emulsifier, high shear mixer, conical blender, V-blender, double cone blender, suspended mixer and combinations thereof. The particle size of the agglomerates may also be reduced using a sonicator. The mixing may be performed at room temperature or at an elevated temperature.

In some embodiments, the fluid medium for the lubricant is mixed with the inorganic fullerene-like and/or tube-like particles having the molecular formula $MX_2$ during the milling step in which the agglomerates of the inorganic fullerene-like and/or tube-like particles having the molecular formula $MX_2$ are mechanically broken down into their primary size. The inorganic fullerene-like and/or tube-like particles having the molecular formula $MX_2$ may be mixed with the fluid medium in an amount ranging from 0.1% to 60% by volume. In another embodiment, the inorganic fullerene-like and/or tube-like particles having the molecular formula $MX_2$ may be mixed with the fluid medium in an amount ranging from 0.5% to 40% by volume. In yet another embodiment, the inorganic fullerene-like and/or tube-like particles having the molecular formula $MX_2$ may be mixed with the fluid medium in an amount ranging from 0.5% to 20% by volume.

In some embodiments, the agglomerates of the inorganic fullerene-like and/or tube-like particles having the molecular formula $MX_2$ is reduced during the milling step to a diameter ranging from 1 nm to 15 μm for fullerene like geometries. In another embodiment, the agglomerates of the inorganic fullerene-like and/or tube-like particles having the molecular formula $MX_2$ is reduced during the milling step to a diameter ranging from 2 nm to 10 μm for fullerene like geometries. In yet another embodiment, the agglomerates of the inorganic fullerene-like and/or tube-like particles having the molecular formula $MX_2$ is reduced during the milling step to a diameter ranging from 5 nm to 5 μm for fullerene like geometries. Following milling, the inorganic fullerene-like and/or tube-like particles having the inorganic fullerene like geometry may have a diameter that is any value within the above ranges. It is noted that the above dimensions are provided for illustrative purposes only, and are not intended to limit the present disclosure.

In some embodiments, the agglomerates of the inorganic fullerene-like and/or tube-like particles having the molecular formula $MX_2$ is reduced during the milling step to a diameter ranging from 1 nm to 150 nm, and a length that ranges from 1 nm to 20 cm, for tube like geometries. In another embodiment, the agglomerates of the inorganic fullerene-like and/or tube-like particles having the molecular formula $MX_2$ is reduced during the milling step to a diameter ranging from 5 nm to 125 nm, and a length that ranges from 5 nm to 15 cm, for tube like geometries. In yet another embodiment, the agglomerates of the inorganic fullerene-like and/or tube-like particles having the molecular formula $MX_2$ is reduced during the milling step to a diameter ranging from 10 nm to 100 nm, and a length that ranges from 100 nm to 10 cm, for tube-like geometries. Following milling, the inorganic fullerene-like and/or tube-like particles having the inorganic tube-like geometry may have a diameter and length that is any value within the above ranges. It is noted that the above dimensions are provided for illustrative purposes only, and are not intended to limit the present disclosure.

In some embodiments, once the agglomerates of the inorganic fullerene-like and/or tubelike particles having the molecular formula $MX_2$ are broken down into their primary size, the functionalizing agent may be added to the mixture of the fluid medium and the inorganic fullerene-like and/or tube-like particles having the molecular formula $MX_2$.

A functionalizing agent of amine may be added to the mixture in an amount ranging from 0.1 wt % to 50 wt. % of the inorganic fullerene-like and/or tube-like particles. For example, when functionalizing agent is an amine, such as oleylamine, the minimum functionalizing agent would be 0.1 g for 1 gram of inorganic fullerene-like and/or tube-like particles having the molecular formula $MX_2$, e.g. 1 gram of fullerene-like tungsten disulfide ($WS_2$), in 100 grams of the fluid medium, e.g., an olefin based oil. For example for 100 grams of isomerized alpha olefin fluid (drilling fluid) 1 wt % i.e. 1 gram of $WS_2$ fullerene-like particles and 0.1 gram of oleilamine are added). In another example, when functionalizing agent is an amine, such as oleylamine, the maxiumum functionalizing agent would be 20 grams for 1 gram of inorganic fullerene-like and/or tube-like particles having the molecular formula $MX_2$, e.g. 1 gram of fullerene-like tungsten disulfide ($WS_2$) or molybdenum disulfide ($MoS_2$), in 100 grams of the fluid medium, e.g., an olefin based oil.

A functionalizing agent of silane may be added to the mixture in an amount ranging from 0.1 wt % to 50 wt. % of the inorganic fullerene-like and/or tube-like particles. For example, when functionalizing agent is a silane, e.g., octadecyltrichlorosilane (OTS), the minimum functionalizing agent would be 0.1 g for 1 gram of inorganic fullerene-like and/or tube-like particles having the molecular formula $MX_2$, e.g., 1 gram of fullerene-like tungsten disulfide ($WS_2$), in 100 grams of the fluid medium, e.g., an olefin based oil. In another example, when functionalizing agent is an silane, e.g., octadecyltrichlorosilane (OTS), the maxiumum functionalizing agent would be 50 grams for 1 gram of inorganic fullerene-like and/or tube-like particles having the molecular formula $MX_2$, e.g. 1 gram of fullerene-like tungsten disulfide ($WS_2$), in 100 grams of the fluid medium, e.g., an olefin based oil.

The functionalizing agent applied to the mixture of the fluid medium and the inorganic fullerene-like and/or tube-like particles having the molecular formula $MX_2$ provide dispersions that do not agglomerate or settle for a period of time that may range from 3 hours to 5 years. In another embodiment, the functionalizing agent applied to the mixture of the fluid medium and the inorganic fullerene-like and/or tube-like particles having the molecular formula $MX_2$ provide dispersions that do not agglomerate or settle for a period of time that may range from 5 hours to 3 years. In yet another embodiment, the functionalizing agent applied to the mixture of the fluid medium and the inorganic fullerene-like and/or tube-like particles having the molecular formula $MX_2$ provide dispersions that do not agglomerate or settle for a period of time that may range from 24 hours to 1 year.

Figure 8:
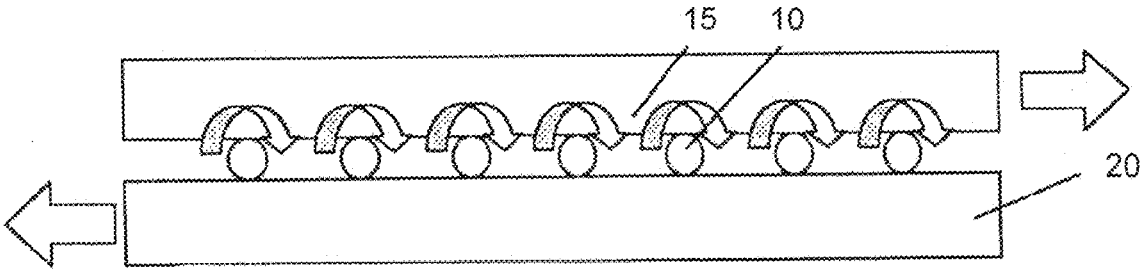
FIG. 8 is a pictorial view depicting an intercalation compound that is in simultaneous contact with two surfaces being lubricated by a rolling action of the intercalation compound, in accordance with one embodiment of the present disclosure.
Figure 9:
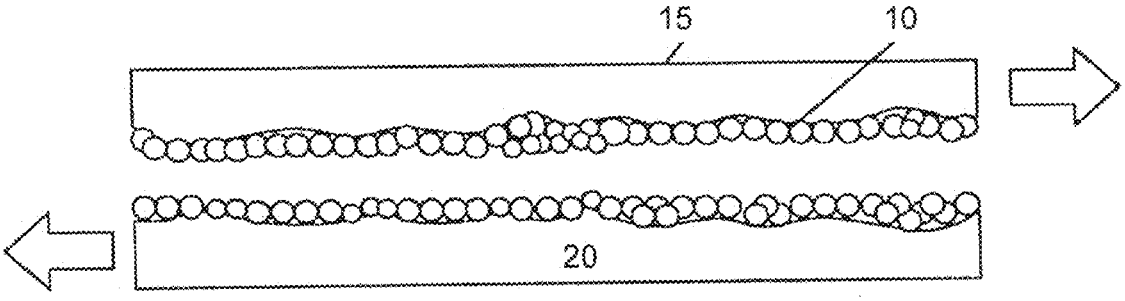
FIG. 9 is a pictorial view depicting multiple layers of intercalation compound that is in simultaneous contact with two surfaces being lubricated by a rolling action of the intercalation compound, in accordance with one embodiment of the present disclosure.

FIGS. 8 and 9 depict how the sphere geometry of the inorganic fullerene-like particles 10 having the molecular formula $MX_2$ provide roller effect when simultaneously in contract with opposing surfaces 15, 20 that are being lubricated. More specifically, the rolling action of the sphere geometry of the inorganic fullerene-like particles 10 provides a low friction sliding motion between the opposing surfaces 15, 20 being lubricated. The sphere geometry of the inorganic fullerene-like particles 10 acts as an anti-friction agent enhancing the effectiveness of the fluid lubricant. The column shape of the tube-like particles having the molecular formula $MX_2$ provide a roller effect similar to the performance that is provided by the sphere geometry of the inorganic fullerene-like particles 10.

Figure 7:
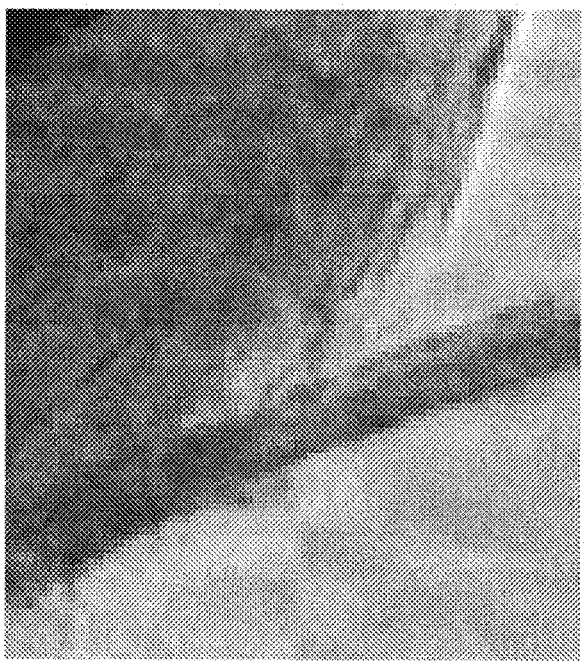
FIG. 7 is transmission electron microscope (TEM) image of a multi-layered nanosphere of metal chalcogenide having a molecular formula $MX_2$ with a fullerene-like geometry under a stress that exfoliates tribofilm lamellas that fill and re-smooth damaged surfaces, in accordance with one embodiment of the present disclosure.
Figure 10:
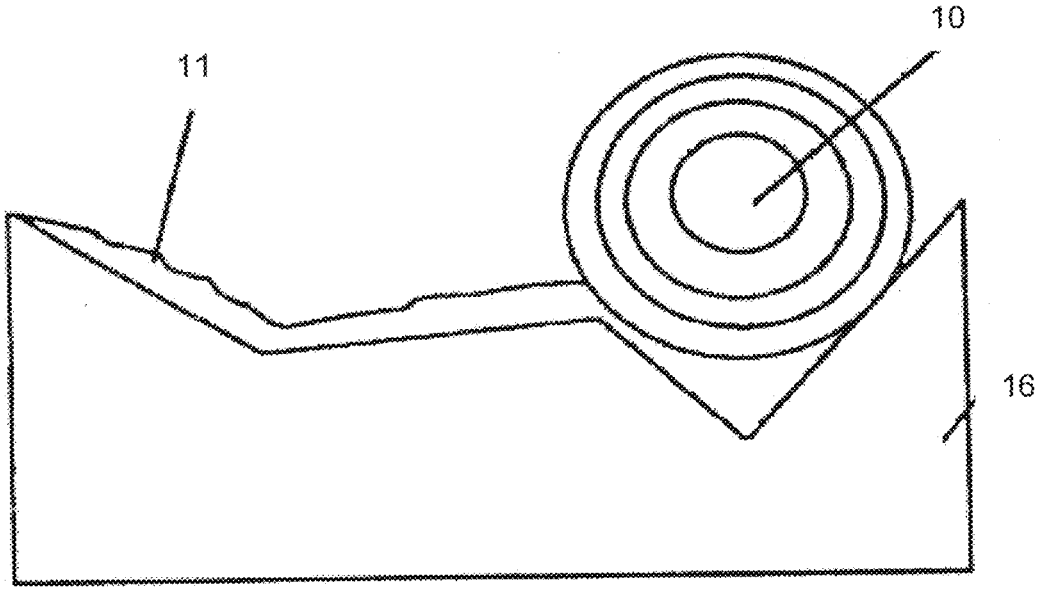
FIG. 10 is a pictorial view depicting a layer of the intercalation compound adhering to a surface that is being lubricated by the intercalation compound, in accordance with one embodiment of the present disclosure.

FIGS. 7 and 10 further depict a surface reconditioning effect that is provided by the lubricant including the fluid medium containing the inorganic fullerene-like and/or tube-like particles 10 having the molecular formula $MX_2$ and the functionalizing agent. More specifically, the inorganic fullerene-like and/or tube-like particles 10 having the molecular formula $MX_2$ are layered structures, in which when the exterior layers contact the surface being lubricated, the exterior layer 11 peels (also referred to as exfoliates) from the inorganic fullerene-like and/or tube-like particles and adheres to the surface 16 being lubricated, as depicted in FIG. 10. An inorganic fullerene-like and/or tube-like particle of tungsten disulfide ($WS_2$) may have alternating layers of tungsten (W) and sulfur (S). An inorganic fullerene-like and/or tube-like particle of molybdenum disulfide ($MoS_2$) may have alternating layers of molybdenum (Mo) and sulfur (S). One molybdenum (Mo) atom is sandwiched between two hexagonally packed sulfur atoms. The bonding between Mo and two S is covalent, however the bonding between each $MoS_2$ sandwich is week (Vander Waals). In this manner, the inorganic fullerene-like and/or tube-like particles having the molecular formula $MX_2$, such as molybdenum disulfide ($MoS_2$) and tungsten disulfide ($WS_2$), can deposit a metal-chalcogen (metal-sulfide for example) layer, such as molybdenum ($MoS_2$) or tungsten ($WS_2$), on the eroded surface being lubricated. Therefore, the inorganic fullerene-like and/or tube-like particle can recondition eroded surfaces, i.e., smooth rough and damaged surfaces, and lubricate to protect from additional wear. In some embodiments, the hollow feature of the inorganic fullerene-like and/or tube-like particle provides enhanced impact resistance.

As noted above, the intercalation compound may further include carbon containing compounds and boron containing compounds. For example, the carbon containing compounds may be graphene and/or graphite.

Graphite is a layer lattice lamella crystal structure where the bonds between the carbon atoms in the crystal structure of the layer are stronger than the carbon bonds between layers. Graphite is comprised of carbon and water vapor. Each carbon atom is bonded to three other surrounding carbon atoms. The flat rings of carbon atoms are bonded into hexagonal structures, which may be referred to as a benzene ring. These plates exist in layers, which are not covalently connected to the surrounding layers.

Graphene can essentially be a single layer of graphite. Graphene being two-dimensional material, offers unique friction and wear properties that is not typically seen in conventional materials. Graphene can serve as a solid or colloidal liquid lubricant. The atomically thin nature of graphene and its ability to conformally coat micro-scale and nano-scale objects simply by dispensing graphene flakes via solution make it a potential low friction and wear resistance coating that would extend the lifetime of the structures to which it is applied.

Graphene and/or graphite as employed in the present compositions may have a 2D geometry, be multi-layered, be a single layer, have a platelet geometry, or have a flake like geometry. The graphene and/or graphite may also be present as graphitic fibers. The graphene and/or graphite may have a width ranging from 5 nm to 990 nm, and a height ranging from 5 nm to 990 nm, and a thickness of a 1 monolayer to 100 monolayers of carbon. In another example, when the intercalation compound is a microscale particle, the platelet geometry may have a width ranging from 1 micron to 100 microns, a height ranging from 1 micron to 100 microns, and may have a thickness ranging from 1 monolayer to 100 monolayers of carbon.

Other carbon containing materials, such as carbon black (CB), and diamond like carbon (DLC) may also be present. Carbon black (also known as acetylene black, channel black, furnace black, lamp black or thermal black) is also suitable for providing the at least one carbon containing nanomaterial that is present in the lubricant. Carbon black is a material produced by the incomplete combustion of heavy petroleum products such as FCC tar, coal tar, ethylene cracking tar, and a small amount from vegetable oil.

The carbon containing material may also be provided by carbon nanotubes or carbon fullerenes. The carbon nanotubes may be single wall carbon nanotubes (CNT) or multi-wall carbon nanotubes (SWNT). The carbon nanotubes and/or carbon fullerenes may be solid particles suspended within the oil base of the composition, which may be from 1 nm to 10 microns in size. The diameter of a single wall carbon nanotube may range from about 1 nanometer to about 50 nanometers. In another embodiment, the diameter of a single wall carbon nanotube may range from about 1.2 nanometers to about 1.6 nanometers. In one embodiment, the nanotubes used in accordance with the present invention have an aspect ratio of length to diameter on the order of approximately 200:1.

In some examples, the carbon containing material, e.g., graphene, graphite, carbon nanotubes, carbon fullerenes and combinations thereof, may be present in the industrial lubricant in an amount equal to 1%, 5%, 10%, 15%, 20%, 25%, and 30%, and any range including an upper limit value and a maximum limit value provided by any of the above examples.

The intercalation compound may further include a boron containing compound. One example of a boron containing compound that is suitable for use with the compositions that are disclosed herein includes boron nitride (BN), such as hexagonal boron nitride (BN). More specifically, in some examples, the hexagonal boron nitride powders (BN) have lamellar structures similar to graphite. The boron containing material may be solid particles suspended within the oil base of the composition, which may be from 1 nm to 10 microns in size. In some examples, the boron containing material, e.g., boron nitride (BN) having hexagonal crystalline structure, may be present in the industrial lubricant an amount equal to 1%, 5%, 10%, 15%, 20%, 25%, and 30%, and any range including an upper limit value and a maximum limit value provided by any of the above examples.

In some embodiments, the industrial lubricant composition may further comprise a high viscosity fluid thickener, such as blown seed oils, blown fats, telemers derived from triglycerides, high molecular weight complex esters, polyalkylmethacrylates, polymethacrylate copolymers, styrene-butadiene rubber, malan-styrene copolymers, polyisobutylene, and ethylene-propylene copolymers. Preferably, blown castor oil (e.g. Peacock Blown Castor Oil Z-8) and a complex ester (e.g. Lexolube CG-5000) are used. In some embodiments, the thickener is present in an amount of up to or about 10, 15, 20, 25, 30 or 35% of the composition.

In some embodiments, the industrial lubricant composition may further be composed of a coupling agent and/or surfactant to improve the stability and compatibility of all the ingredients. Such coupling agents as polyethylene glycol esters, glyceryl oleates, sorbitan oleates, and fatty alkanol amides are generally found to be effective. The composition may be composed of up to about 10% coupling agent and/or surfactant. Preferably the coupling agent and/or surfactant is in the amount of up to or about 1, 2, 3, 5, 7 or 7.5% of the composition.

The working strength straight oil composition may comprise a surfactant (detergent). Detergents (surfactants) for the compositions disclosed herein may further include the metal salts of sulfonic acids, alkylphenols, sulfurized alkylphenols, alkyl salicylates, naphthenates and other oil soluble mono and dicarboxylic acids, such as tetrapropyl succinic anhydride. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur. Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

In another embodiment of the industrial lubricant compositions disclosed herein, the composition may further comprise an antioxidant and/or a dispersant to reduce or effectively avoid varnish, gum and sludge formation. Both hindered phenols and aromatic amines are effective. Succinimides are found to be good dispersants for methyl soyate-based lubricants. The composition may be composed of up to about 25% antioxidant and/or dispersant. Preferably, the antioxidant and/or dispersant is present in the amount of up to or about 1, 3, 5, 7, 10, or 15% of the composition.

In yet a further aspect of the disclosure, an anti-bacterial and/or antifungal compound is used to prevent the formation of fungus or bacteria. In addition, water-based metalworking fluids need to be alkaline in pH to minimize problems such as metal corrosion and the growth of microbials. The desired pH is from about 8.5 to about 10. The soluble oil can be diluted with water to a use dilution between about 2% and about 50% (in a dilution range of about 50:1 to 1:1). When diluted to a use level of 5% (20:1), the pH of the two fluids is in the desired range.

In some embodiments, ratio of base oil, e.g., vegetable oil, to the phosphorus-based non-chlorine additive to the at least one intercalation compound of the metal chalcogenide ranges from 11:1:0.2 to 3:1:0.06.

In some examples, the industrial lubricant may be employed as a metal working fluid, gear oil, hydraulic oil, turbine oil or a combination thereof. In order to satisfy the specific needs of the ultimate user, it is often necessary for the lubricant to have various performance characteristics. A lubricant's performance characteristics are often measured in terms of four-ball EP LWI (Extreme Pressure Load Wear Index), four-ball Weld Point, four-ball ISL (Initial Seizure Load) and Falex Fail Load. Although each of these characteristics has associated desirable levels, the specific needs of a specific lubricant user may require that no more than one parameter falls within the desirable range.

For high performance metalworking lubricants, as used herein, the phrase "working strength" refers to the concentration at which the lubricant is used—as is for a straight oil lubricant, or with dilution for a soluble oil. The performance is measured at working strength and while a soluble oil is not typically measured by a four-ball test, a soluble oil at working strength after a standard dilution with water (e.g. 1 to 20) should impart a Falex fail load of at least 4000 lbs., preferably 4500 lbs. A lubricant composition with "good stability" as used herein refers to a homogenous composition that will not show any sign of separation, change in color or clarity for a sustained period typically at least one and preferably at least three or at least six months.

In some embodiments, the industrial lubricant composition that is disclosed herein has enhanced load carrying performance as measured using four ball-LWI testing. As used herein, the phrase "four-ball LWI", also known as a measure of load carrying capacity, refers to an index of the ability of a lubricant to prevent wear at applied loads. Under the conditions of this test, specific loadings in kilogram-force, having intervals of approximately 0.1 logarithmic units, are applied by a rotating ball to another three stationary balls for ten runs prior to welding (ASTM D2783). The industrial lubricant compositions can provide an LWI value of at least about 40. A high performance metalworking lubricant according to the invention is one that has a LWI value of 130 or higher.

In some embodiments, the industrial lubricant composition that is disclosed herein has an enhanced extreme pressure level, as measured using four-ball test extreme pressure (last non-seizure load) testing. As used herein, the phrase "four-ball test extreme pressure (last non-seizure load)" or "four-ball weld point" refers to the lowest applied load, in kilogram-force, at which the rotating ball seizes and then welds to the three stationary balls. This indicates that the extreme pressure level of the lubricant has been exceeded (ASTM D2783). The test indicates levels stepwise, at 400, 500, 620, 800, and the top value of 800+. A high performance metalworking lubricant as defined here is one that has a weld point of at least 620 kg, preferably 800 kg or exceeding 800 kg (800+).

In some embodiments, the industrial lubricant composition that is disclosed herein has an enhanced initial seizure load, as measured using four-ball ISL testing. As used herein, the phrase "four-ball ISL" (initial seizure load) refers to the lowest applied load, in kilogram-force, at which that metal to metal contact between the rotating ball with the three stationary balls occurs. A high performance metalworking lubricant as defined here should have an ISL value of 120 kg or higher. This value is also a measure of the lubricant's film strength.

In some embodiments, the industrial lubricant composition that is disclosed herein has improved wear preventative properties, as measured using four-ball wear testing. The term "four-ball wear test" is a test method used to determine the relative wear preventive properties of lubricating fluids in sliding contact under the prescribed test conditions, in accordance with ASTM D4172. In some embodiments, a 4-ball extreme anti-wear test including a 40 kg load for 1 hour at 1200 rpm applied to a metal surface lubricated with the composition at room temperature, i.e., 25° C., in accordance with the present disclosure provided a value of 510 μm or less.

The Falex Pin and Vee Block test method consists of running a rotating steel journal at 290 plus or minus 10 rpm against two stationary V-blocks immersed in the lubricant sample. Load (pound-force) is applied to the V-blocks by a ratchet mechanism. Increasing load is applied continuously until failure. The fail load value obtained serves to differentiate fluids having low, medium and high level extreme pressure properties. A high performance metalworking lubricant as defined here is one that has a minimum fail load value of 4,000 lbs., preferably 4500 lbs. or exceeding 4500 lbs. This method (ASTM D 3233) is particularly useful for diluted soluble oil samples.

The industrial lubricant formulations disclosed herein can provide surprising and unexpected performance characteristics superior to existing industrial lubricant formulations, in that they can impart a four-ball EP weld point (ASTM D 2783) of at least 250 kg, preferably 620 kg, many as high as 800 kg, and even 800+kg, as demonstrated by the experimental data provided below in Tables I and IV, as well as FIGS. 12-17.

Figure 11:
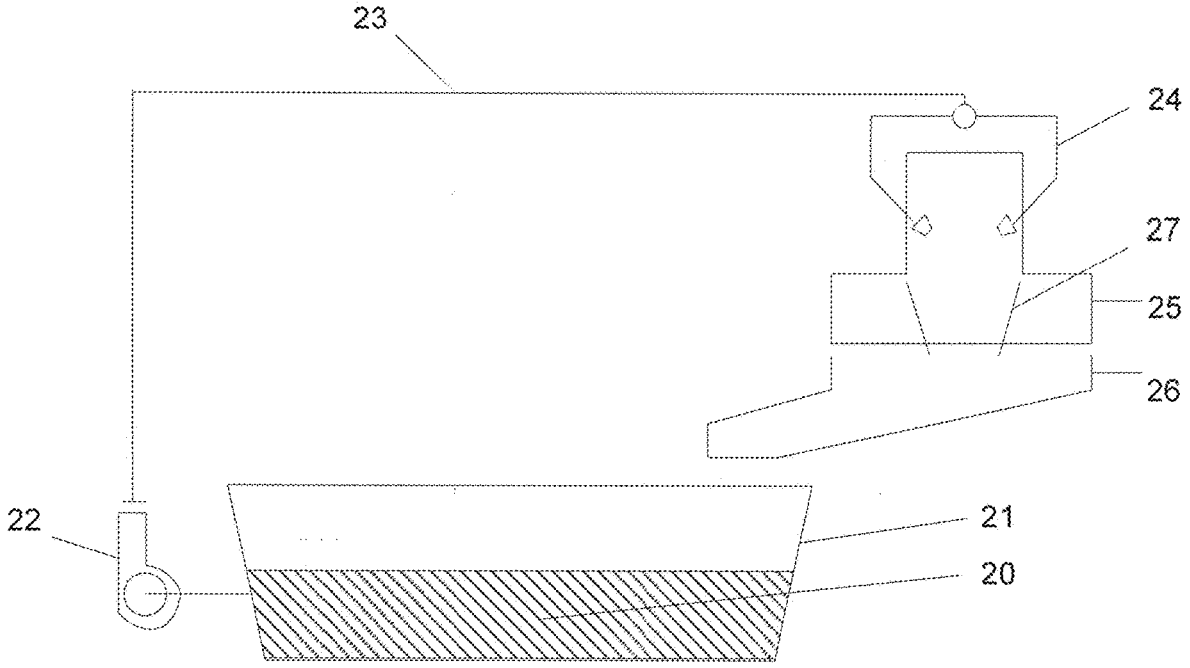
FIG. 11 is a schematic of a system for applying the industrial lubricant to a metal working apparatus, in accordance with one embodiment of the present disclosure.

Referring to FIG. 11, in another aspect of the present disclosure, an industrial lubrication method is provided that includes providing a metal substrate and applying an industrial lubricant composition 20 to the metal substrate. The industrial lubricant composition 20 has been described in detail above, and may include an oil base selected from the group consisting of vegetable oil, Group I type oil, Group II type oil, Group III type oil, Group IV type oil, Group V type oil, and combinations thereof; a phosphorus-based non-chlorine additive; and at least one intercalation compound of a metal chalcogenide, a carbon containing compound and a boron containing compound. The intercalation compound of the industrial lubricant may have a geometry that is a platelet shaped geometry, a spherical shaped geometry, a multi-layered fullerene-like geometry, a tubular-like geometry or a combination thereof. Following application of the industrial lubricant the metal substrate may be worked.

In some embodiments, the industrial lubricant 20 may be applied to a metal substrate prior to being worked by a machine tool 25 that provides a metal working function. The metal substrate may be a preformed blank shape for threading, metal sheet, metal plate, or a combination thereof. The metal substrate may be comprises of steel, stainless steel, aluminum, copper, brass, titanium, platinum, iron, cast iron, nickel or an alloy or combination thereof.

The metal tool 25 that is depicted in FIG. 11 may work the metal substrate by cutting, chip, burning, drilling turning, milling, grinding, sawing, threading, filing, drawing, deep drawing, forming, necking, stamping, planning, rabbeting, routing, broaching or a combination thereof.

Applying of the industrial lubricant composition 20 may include flooding, spraying, dripping, misting, brushing, through-tool coolant systems, or a combination thereof. In the example that is depicted in FIG. 11, the industrial lubricant composition 20 may be applied using a spray and/or mist applicator 24. The spray and/or mist applicator 24 may be connected to a reservoir 21 for containing the industrial lubricant composition 20. A pump 22 may transport the industrial lubricant 20 from the reservoir 21 across at least one line 23 to the spray and/or mist applicator 24. In some embodiments, the metal tool 25 may include a return 26 for returning the excess industrial lubricant that spills from the metal tool and/or metal substrate, e.g., shedding industrial lubricant 27, to the reservoir 21.

Although the industrial lubricant has been depicted in FIG. 11 as being applied in metal working applications, the industrial lubricant composition of the present disclosure is not limited to only this application. For example, the industrial lubricant may also be employed as a gear oil, hydraulic oil, turbine oil or a combination thereof.

The compositions and methods disclosed herein provide very low wear of contacting components, protection of tools, i.e., extends tool lifetime, excellent ultra pressure protection, and the prevention of welding of the work pieces. The compositions and methods disclosed herein also provide excellent cooling and lubrication in metal working applications to provide high quality surface finishes. In some embodiments, the lubricant compositions disclosed herein are suitable for a number of metals, are easily removed, rapidly dissipate heat, have a mild-non-offensive odor and will not smoke. Further, in some embodiments, the lubricant compositions that are disclosed herein do not stain steel, copper, brass or bronze materials, or alloys thereof.

The following examples are provided to further illustrate the present invention and demonstrate some advantages that arise therefrom. It is not intended that the invention be limited to the specific examples disclosed.

EXAMPLES

Industrial lubricant compositions were prepared in accordance with the present disclosure, the compositions of which are listed in Tables 1-4, below. The industrial lubricant composition (hereafter referred to as Composition 1) included in Table 1 includes at least an industrial lubricant of a paraffinic oil base having a viscosity of 125P, inorganic fullerene type metal chalcogenide, $WS_2$, intercalation agent, and extreme pressure sensitive additive provided of amine phosphate. Composition 1 is as follows:

TABLE 1

| COMPOSITION 1 | | |
|---|---|---|
| COMPONENT | COMPONENT TYPE | CONCENTRATION WT. % |
| Paraffinic oil having a viscosity of 125 P | Base Oil 1 | 40.5 |
| Group I Base Oil 150NS | Base Oil 2 | 15 |
| Electro ionized vegetable oil and/or vegetable oil and mineral oil blend | Smoothness Agent + VI improver/EP enhancer | 15 |
| Calcium Sulfonate | | 10 |
| Amine Phosphate | Extreme Pressure Sensitive Additive | 15 |
| Polyethylene Glycol 400 Monooleate | Compatibilizing Agent | 2 |
| Inorganic fullerene metal chalcogenide | intercalation agent | 2.5 |

The paraffinic oil having the viscosity of 125P was provided by Q8 Oils of Kuwait Petroleum International under the brand name Q8 Puccini 125P, which is a hydro treated paraffinic oil. Composition 1 also includes a group I base oil of type 150NS, which is a mineral oil having a high saturate concentration. The composition further included a smoothness agent/VI improver/EP enhancer, which was provided by an electro-ionized vegetable oil/vegetable oil and mineral oil blend. In Composition 1, the smoothness agent/VI improver/EP enhancer was provided by Elektrion R available from Inwoo Corp. The composition further included calcium sulfonate, which was commercially available as Arcot 785 from PCAS LLC. The calcium sulfonate can function as a physical and chemical barrier on the metal surface to be worked, and can act as an anti-corrosion additive. The extreme pressure additive was provided by an amine phosphate available under the tradename Desilube 77 from Desilube Technology Inc. The compatibilizing agent may be Polyethylene Glycol 400 Monooleate, which was provided by Pegosperse® 400M available from Lonza Inc. The inorganic fullerene type metal chalcogenide intercalation agent as tungsten disulfide ($WS_2$) in NW40 that was produced by milling for 17 hours.

The industrial lubricant composition (hereafter referred to as Composition 2) included in Table 2 includes at least an industrial lubricant of a paraffinic oil base having a viscosity of 475P, inorganic fullerene type metal chalcogenide, $WS_2$, intercalation agent, and extreme pressure sensitive additive provided of amine phosphate. Composition 2 is as follows:

TABLE 2

| COMPOSITION 2 | | |
|---|---|---|
| COMPONENT | COMPONENT TYPE | CONCENTRATION WT. % |
| Paraffinic oil having a viscosity of 475 P | Base Oil 1 | 40.5 |
| Group I Base Oil 150NS | Base Oil 2 | 15 |
| Electro ionized vegetable oil/vegetable oil and mineral oil blend | Smoothness Agent + VI improver/EP enhancer | 15 |
| Calcium Sulfonate | | 10 |
| Amine Phosphate | Extreme Pressure Sensitive Additive | 15 |
| Polyethylene Glycol 400 Monooleate | Compatibilizing Agent | 2 |
| Inorganic fullerene type metal chalcogenide | intercalation agent | 2.5 |

Composition 2 is similar to Composition 1, with the exception that the paraffinic oil having the viscosity of 125P in Composition 1 is replaced with paraffinic oil having a viscosity of 475P. Composition 2 includes paraffinic oil having the viscosity of 475P that was provided by Q8 Oils of Kuwait Petroleum international under the brand name Q8 Paganini 475P, which is a hydro treated paraffinic oil. Similar to Composition 1, Composition 2 includes a group I base oil of type 150NS; a smoothness agent/VI improver/EP enhancer available from Inwoo Corp. under the brand name Elektrion R; calcium sulfonate, available as Arcot 785 from PCAS LL; and an extreme pressure additive available under the tradename Desilube 77 from Desilube Technology Inc. The compatibilizing agent in Composition 2 was Polyethylene Glycol 400 Monooleate, which was provided by Pegosperse® 400M available from Lonza Inc. The inorganic fullerene type metal chalcogenide intercalation agent in Composition 2 was tungsten disulfide ($WS_2$) in NW40 that was produced by milling for 17 hours.

The industrial lubricant composition (hereafter referred to as Composition 3) included in Table 3 includes at least a gas to liquid (GTL) formed paraffinic oil base, inorganic fullerene type metal chalcogenide, $WS_2$, intercalation agent, and extreme pressure sensitive additive provided of amine phosphate. Composition 3 is as follows:

TABLE 3

| COMPOSITION 3 | | |
|---|---|---|
| COMPOSITION | COMPONENT TYPE | CONCENTRATION WT. % |
| Group I paraffinic base oil formed by gas to liquid (GTL) having aniline point of 110 C. | Base Oil 1 | 40.5 |
| Group I Base Oil 150NS | Base Oil 2 | 15 |

TABLE 3-continued

| COMPOSITION 3 | | |
|---|---|---|
| COMPOSITION | COMPONENT TYPE | CONCENTRATION WT. % |
| Electro ionized vegetable oil/vegetable oil and mineral oil blend | Smoothness Agent + VI improver/EP enhancer | 15 |
| Calcium Sulfonate | | 10 |
| Amine Phosphate | Extreme Pressure Sensitive Additive | 15 |
| Polyethylene Glycol 400 Monooleate | Compatibilizing Agent | 2 |
| Inorganic fullerene type metal chalcogenide | intercalation agent | 2.5 |

Composition 3 is similar to Compositions 1 and 2, with the exception that the paraffinic oil having the viscosity of 125P, 475P in Compositions 1 and 2 is replaced with a Group I paraffinic base oil formed by gas to liquid (GTL) processing having aniline point of 110° C. Gas to liquid process produce base oil for lubricant applications using natural gas as the hydrocarbon source. Typically, the GTL process tears natural gas molecules apart and reassembles them into longer chain molecules, like those that comprise crude oil. Typically, the result is an extremely pure, synthetic crude oil that is virtually free of contaminants such as sulfur, aromatics and metals.

Similar to Compositions 1 and 2, Composition 3 includes a group I base oil of type 150NS; a smoothness agent/VI improver/EP enhancer available from Inwoo Corp. under the brand name Elektrion R; calcium sulfonate, available as Arcot 785 from PCAS LL; and an extreme pressure additive available under the tradename Desilube 77 from Desilube Technology Inc. The compatibilizing agent in Composition 2 was Polyethylene Glycol 400 Monooleate, which was provided by Pegosperse® 400M available from Lonza Inc. The inorganic fullerene type metal chalcogenide intercalation agent in Composition 2 was tungsten disulfide ($WS_2$) in NW40 that was produced by milling for 17 hours.

The industrial lubricant composition (hereafter referred to as Composition 4) included in Table 4 includes at least an industrial lubricant of a grape seed oil, inorganic fullerene type metal chalcogenide, $WS_2$, intercalation agent, and extreme pressure sensitive additive provided of amine phosphate. Composition 4 is as follows:

TABLE 4

| COMPOSITION 4 | | |
|---|---|---|
| COMPOSITION | COMPONENT TYPE | CONCENTRATION WT. % |
| Grape seed oil | Base Oil 1 | 40.5 |
| Group I Base Oil 150NS | Base Oil 2 | 15 |
| Electro ionized vegetable oil/vegetable oil and mineral oil blend | Smoothness Agent + VI improver/EP enhancer | 15 |
| Calcium Sulfonate | | 10 |
| Amine Phosphate | Extreme Pressure Sensitive Additive | 15 |
| Aldo MO | Compatibilizing Agent | 2 |
| Inorganic fullerene type metal chalcogenide | intercalation agent | 2.5 |

Composition 4 is similar to Compositions 1 and 2, with the exception that the paraffinic oil having the viscosity of 125P, 475P in Compositions 1 and 2 is replaced with a grape seed oil. Similar to Compositions 1 and 2, Composition 4 includes a group I base oil of type 150NS; a smoothness agent/VI improver/EP enhancer available from Inwoo Corp. under the brand name Elektrion R; calcium sulfonate, available as Arcot 785 from PCAS LL; and an extreme pressure additive available under the tradename Desilube 77 from Desilube Technology Inc. The compatibilizing agent in Composition 4 was Aldo™ MO-PG KFG from Lonza Inc. The inorganic fullerene type metal chalcogenide intercalation agent in Composition 2 was tungsten disulfide ($WS_2$) in NW40 that was produced by milling for 17 hours.

Characterization of Test Compositions

Compositions 1-4 were tested for their use in metal working processes, such as cutting, stamping and drawing. The test compositions, i.e., Compositions 1-4, were also compared with commercially available metal working lubricants, such as metalcut t20 from Metalflow S.A., Condaform 989 from Condat Lubricants; and Matrol EP405CF from Total Lubricants USA, Inc. None of the commercially available metal working lubricants included intercalation compound of metal chalcogenide.

Composition 4 exhibited better anti-wear property in comparison to the commercial products, i.e., metalcut t20 from Metalflow S.A., Condaform 989 from Condat Lubricants; and Matrol EP405CF from Total Lubricants USA, Inc., and meet and/or exceed the required extreme pressure (EP) properties. However, in some examples Composition 4, which included grape seed oil, experienced oxidation at higher temperature. Further, the grade seed containing industrial lubricant composition, i.e., Composition 4, experienced sedimentation. The sedimentation and oxidation issues experienced in Composition 4 where overcome by the industrial lubricant having Compositions 1-3, in which the grade seed oil component of the industrial lubricant was replaced with mineral oils/paraffin oil. The mineral oil/paraffin oil containing industrial lubricants, e.g., Compositions 1-3, exhibited similar anti-wear properties and extreme pressure (EP) properties as the grade seed oil based industrial lubricant, i.e., Composition 4, without experiencing the disadvantageous oxidation and sedimentation. The results of the characterization of Composition 1 is included in Table 5, as follows:

TABLE 5

| CHARACTERIZATION OF COMPOSITION 1 | | |
|---|---|---|
| Property | Value | Method |
| Chlorine, boron content | none | — |
| Active sulfur content | none | — |
| Color | black | — |
| PHYSICO-CHEMICAL PROPERTIES | | |
| Density (23° C.) | 0.88 | Simili ASTM D1217 |
| Flash point (closed cup) (° C.) | >90 | ISO 2719 |
| Kinematic Viscosity at 40° C. (mm2/s | 242 | ISO 3104 |
| Kinematic Viscosity at 100° C. (mm2/s) | 262 | ISO 3104 |
| Viscosity Index | 140 | ISO 3104 |
| TBN (mg KOH/mg) | 24.4 | ASTM D2896 |
| Surface tension (pending droplet) (mN/m) | 30.6 +/− 0.16 | Simili ISO 19403-3 |
| Copper corrosion | 1A | ASTM D130 |
| Cast iron chip corrosion | Pass | Simili - IP 287 |
| TRIBOLOGICAL PERFORMANCES | | |
| 4-ball test extreme pressure (last non-seizure load) (kg) | >800 | ASTM D2783 |
| 4-ball test Anti-Wear 200 kg, 1 hour, 1200 rpm (WSD in microns) | 1554 | |

TABLE 5-continued

| CHARACTERIZATION OF COMPOSITION 1 | | |
|---|---|---|
| Property | Value | Method |
| 4-ball anti-wear 40 kg, 1 hour, 1200 rpm (WSD in microns) | 510 | ASTM D4172 |
| Falex Pin-on | Ongoing | |

Anti-Wear Performance

Compositions 1-4 and the commercially available lubricants, i.e., metalcut t20 from Metalflow S.A., Condaform 989 from Condat Lubricants; and Matrol EP405CF from Total Lubricants USA, Inc., were tested for their wear preventative properties, as measured using four-ball wear testing, in accordance with ASTM D4172. In a first test of anti-wear performance, the 4-ball extreme anti-wear test including a 200 kg load for 1 hour at 1200 rpm was applied to a metal surface lubricated with the composition at room temperature, i.e., 25° C. Composition 1 was first tested in comparison to the commercially available lubricants, i.e., metalcut t20 from Metalflow S.A., Condaform 989 from Condat Lubricants; and Matrol EP405CF from Total Lubricants USA, Inc. The data was plotted in FIG. 12. The plot identified by reference number 30 is the maximum wear scar diameter measured from a tested sample that was lubricated with an industrial lubricant having Composition 1. The plot identified by reference number 35 is the maximum wear scar diameter measured from a tested sample that was lubricated with Matrol EP405CF from Total Lubricants USA, Inc. The plot identified by reference number 40 is the maximum wear scar diameter measured from a tested sample that was lubricated with Matrol EP405CF from Total Lubricants USA, Inc. The plot identified by reference number 40 is the maximum wear scar diameter measured from a tested sample that was lubricated with Condaform 989 from Condat Lubricants. The plot identified by reference number 45 is the maximum wear scar diameter measured from a tested sample that was lubricated with metalcut t20 from Metalflow S.A.

Figure 12:
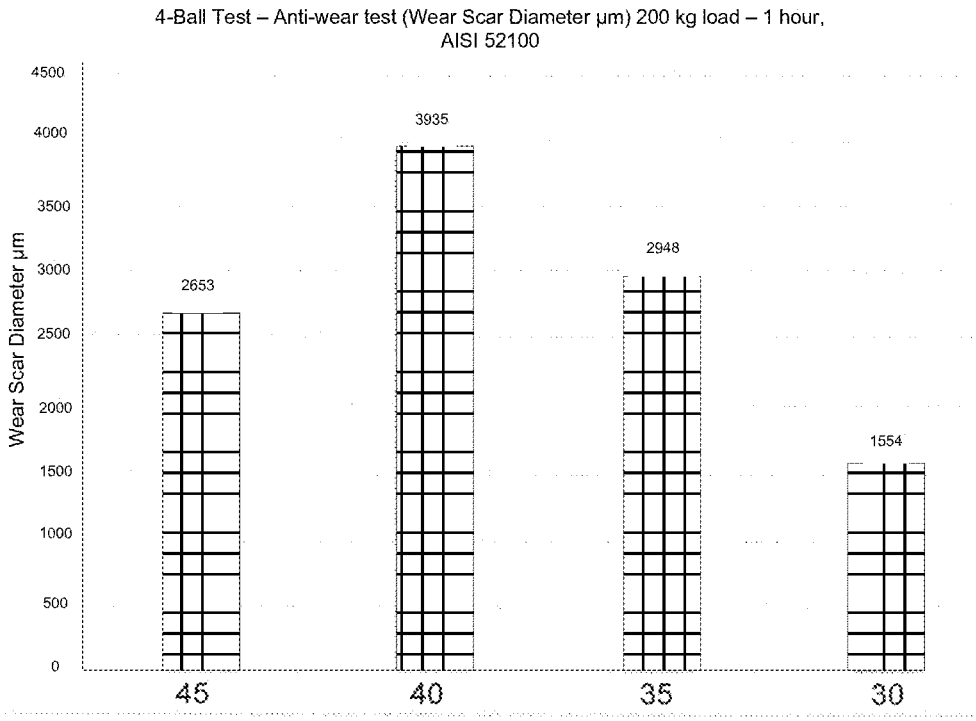
FIG. 12 is a plot illustrating the wear scar diameter data measured from a 4 ball test, i.e., anti-wear test, of industrial lubricant compositions in accordance with the present disclosure in comparison to comparative examples that do not include intercalation compound of metal chalcogenide.

Referring to FIG. 12, the maximum wear scar diameter measured from the sample lubricated by the industrial lubricant of Composition 1 including intercalation compound of metal chalcogenide was approximately 1500 microns, which was more than 1000 microns less than the next highest performing commercially available lubricant, which did not include the intercalation compound of metal chalcogenide.

Figure 13A:
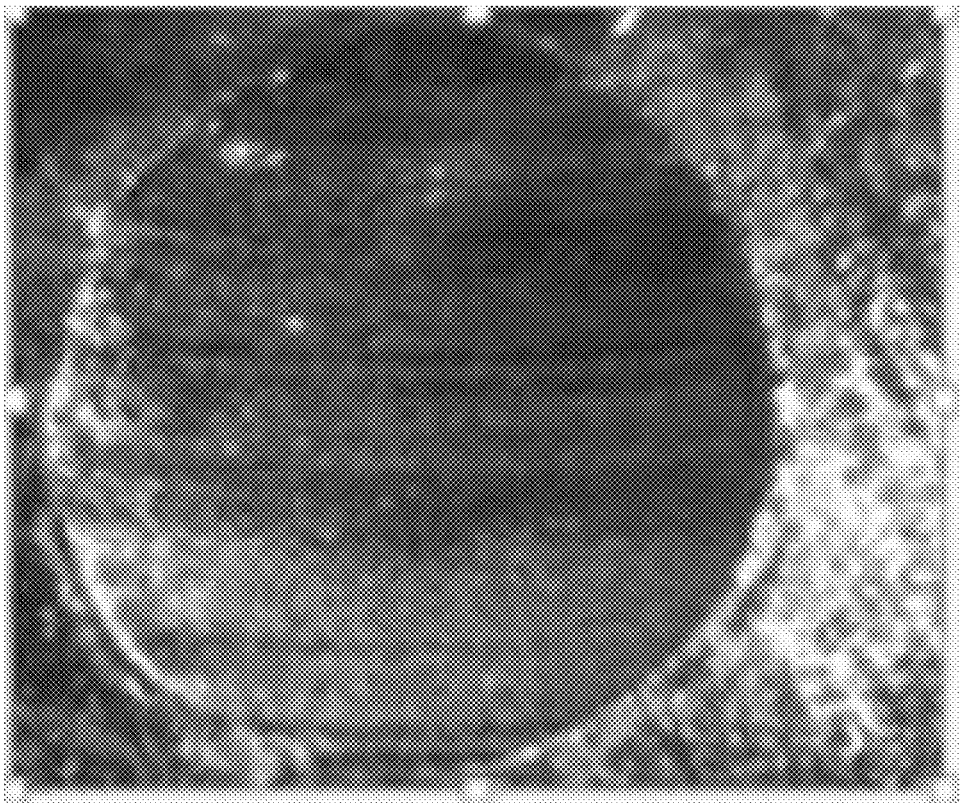
FIG. 13A is a photograph of a metal surface following anti-wear testing, i.e., 4-ball test (AISI 52100) for wear scar diameter, in which the metal surface was lubricated with one embodiment of an industrial lubricant composition including intercalation compounds of metal chalcogenide in accordance with the present disclosure.

FIG. 13A is a photograph of a metal surface following anti-wear testing, i.e., 4-ball test (AISI 52100) for wear scar diameter, in which the metal surface was lubricated with an industrial lubricant having Composition 1, as listed in Table 1. The wear scar depicted in FIG. 13A can be characterized as being clean, circulator, neat and having a smooth surface. The wear scar depicted in FIG. 13A is indicative of an industrial lubricant suitable for metal working operations, in which the industrial lubricant increases tool life, and provides excellent surface finish.

Figure 13B:
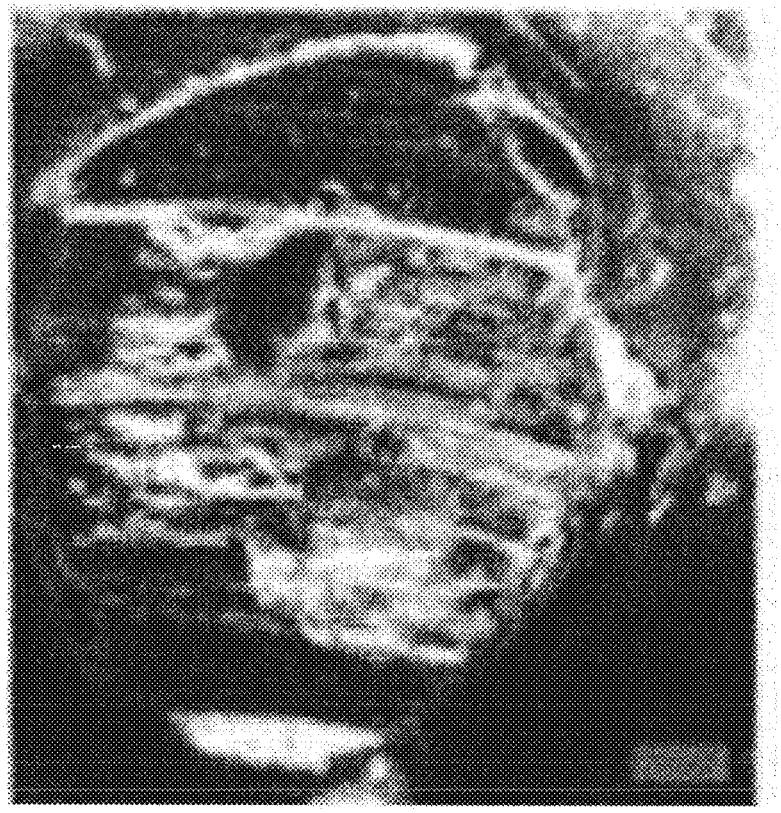
FIGS. 13B-13D are photographs of a metal surface following anti-wear testing, i.e., 4-ball test (AISI 52100) for wear scar diameter, in which the metal surface was lubricated with an industrial lubricant composition that does not include an intercalation compound of metal chalcogenide.
Figure 13C:
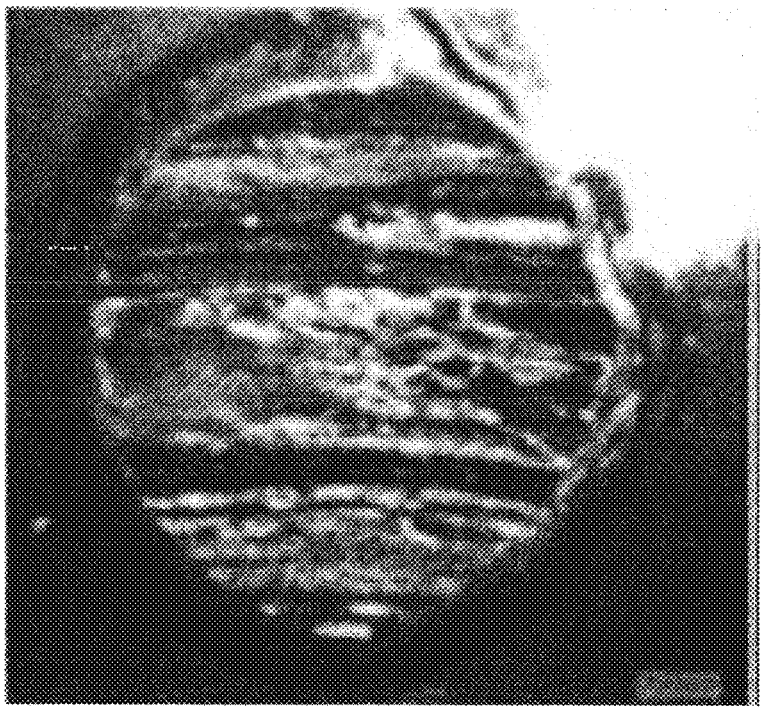
Figure 13D:
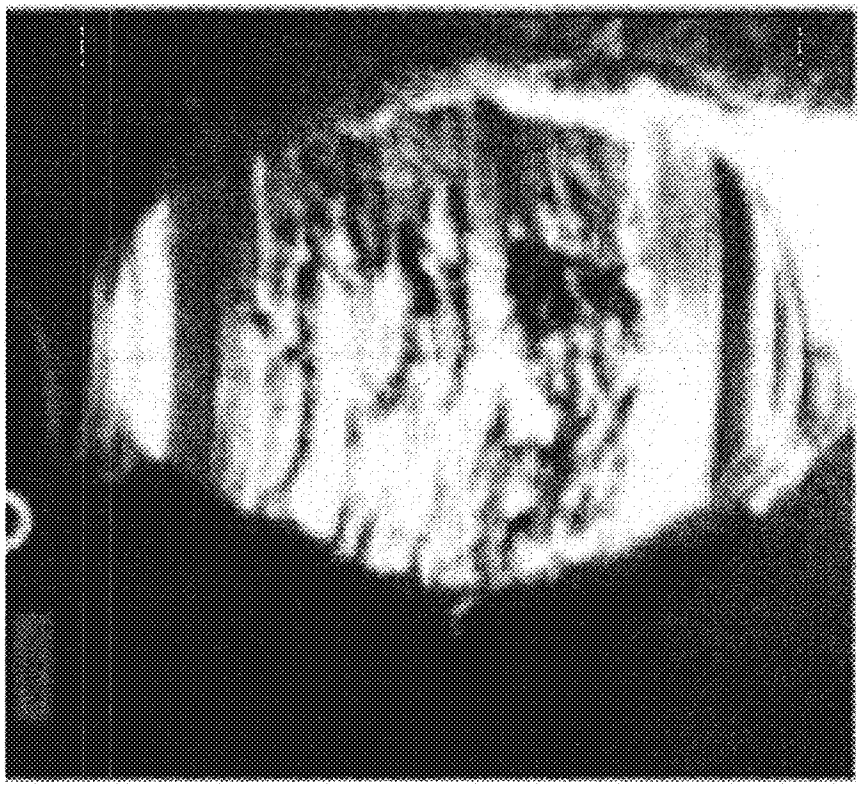

FIG. 13B is a photograph of a metal surface following anti-wear testing, i.e., 4-ball test (AISI 52100) for wear scar diameter, in which the metal surface was lubricated with metalcut t20 from Metalflow S.A. FIG. 13C is a photograph of a metal surface following anti-wear testing, i.e., 4-ball test (AISI 52100) for wear scar diameter, in which the metal surface was lubricated with Condaform 989 from Condat Lubricants. FIG. 13D is a photograph of a metal surface following anti-wear testing, i.e., 4-ball test (AISI 52100) for wear scar diameter, in which the metal surface was lubricated with Matrol EP405CF from Total Lubricants USA, Inc.

Figure 14:
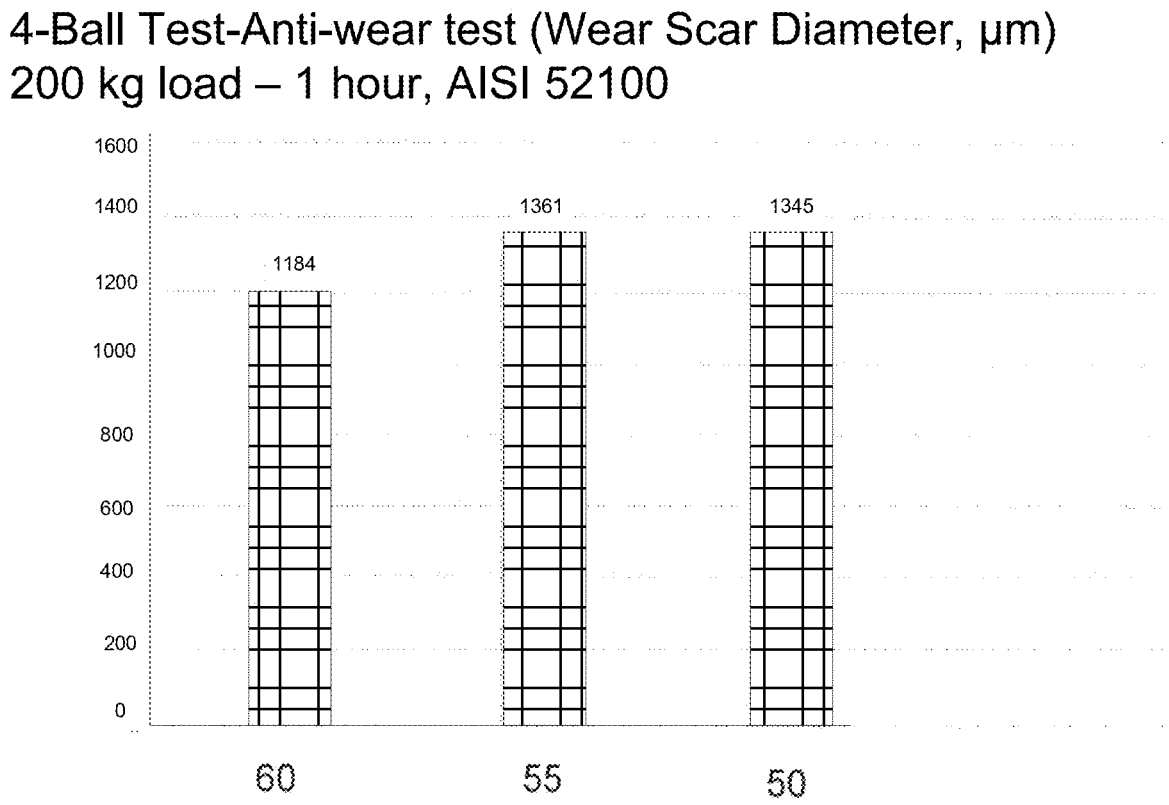
FIG. 14 is a plot illustrating the wear scar diameter data measured from a 4 ball test, i.e., anti-wear test, of additional embodiments of industrial lubricant compositions including intercalation compounds of metal chalcogenide, in accordance with the present disclosure.

FIG. 14 is a plot illustrating the wear scar diameter data measured from a 4 ball test, i.e., anti-wear test, from test samples lubricated with Compositions 2-4, as illustrated in Tables 2-4. The 4 ball test-anti-wear test that produced the data in FIG. 14 included a 200 Kg load for 1 hour (AISI 52100). The plot identified by reference number 50 is the maximum wear scar diameter measured from a tested sample that was lubricated with an industrial lubricant having Composition 1. The plot identified by reference number 55 is the maximum wear scar diameter measured from a tested sample that was lubricated with an industrial lubricant having Composition 3, which included a gas to liquid (GTL) formed paraffinic oil base, inorganic fullerene type metal chalcogenide, i.e., $WS_2$, intercalation agent, and extreme pressure sensitive additive provided of amine phosphate. The plot identified by reference number 60 is the maximum wear scar diameter measured from a tested sample that was lubricated with an industrial lubricant having Composition 4, which included a grape seed oil base, inorganic fullerene type metal chalcogenide, i.e., $WS_2$, intercalation agent, and extreme pressure sensitive additive provided of amine phosphate.

Referring to FIG. 14, the measured wear scar diameter in the sample lubricated by the industrial lubricant of Composition 4, which included a grape seed oil base, inorganic fullerene type metal chalcogenide, i.e., $WS_2$, intercalation agent, and extreme pressure sensitive additive of amine phosphate, indicated a maximum wear scar diameter of approximately 1100 microns. The measured wear scar diameter in the sample lubricated by the industrial lubricants of Compositions 1 and 3 had a maximum wear scar diameter of approximately 1350 microns.

Extreme Pressure Performance

Compositions 1-4 and the commercially available lubricants, i.e., metalcut t20 from Metalflow S.A., Condaform 989 from Condat Lubricants; and Matrol EP405CF from Total Lubricants USA, Inc., were tested for their extreme pressure properties, as measured using four-ball test extreme pressure (last non-seizure load) testing in accordance with ASTM D2783.

Figure 15:
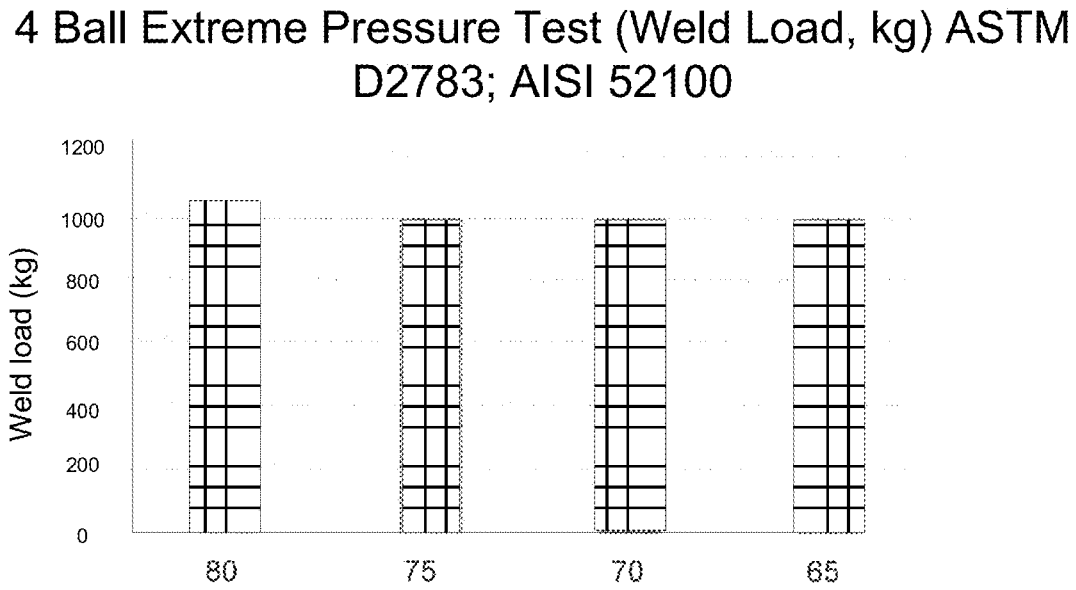
FIG. 15 is a plot illustrating the results of a 4 ball extreme pressure test (ASTM D2783, AISI 52100) for weld load, in which the tested industrial lubricant compositions included intercalation compounds of metal chalcogenide in accordance with the present disclosure and comparative examples that did not include the intercalation compounds of metal chalcogenide.

FIG. 15 is a plot illustrating the results of the 4 ball extreme pressure test (ASTM D2783, AISI 52100) for weld load, in which the tested oil compositions included intercalation compounds of metal chalcogenide in accordance with the present disclosure and comparative examples that did not include the intercalation compounds of metal chalcogenide.

Composition 1 was first tested in comparison to the commercially available lubricants, i.e., metalcut t20 from Metalflow S.A., Condaform 989 from Condat Lubricants; and Matrol EP405CF from Total Lubricants USA, Inc. The data was plotted in FIG. 15. The plot identified by reference number 65 is the maximum weld load measured from a tested sample that was lubricated with an industrial lubricant having Composition 1. The plot identified by reference number 70 is the maximum weld load measured from a tested sample that was lubricated with Matrol EP405CF from Total Lubricants USA, Inc. The plot identified by reference number 75 is the maximum weld load measured from a tested sample that was lubricated with Condaform 989 from Condat Lubricants. The plot identified by reference number 80 is the maximum weld load measured from a tested sample that was lubricated with metalcut t20 from Metalflow S.A.

Referring to FIG. 15, the measured maximum weld load in the sample lubricated by the industrial lubricant of Composition 1 including intercalation compound of metal chalcogenide was approximately 1000 kg, which was at least equal to the commercially available lubricants that did not include the intercalation compound of metal chalcogenide.

Figure 16A:
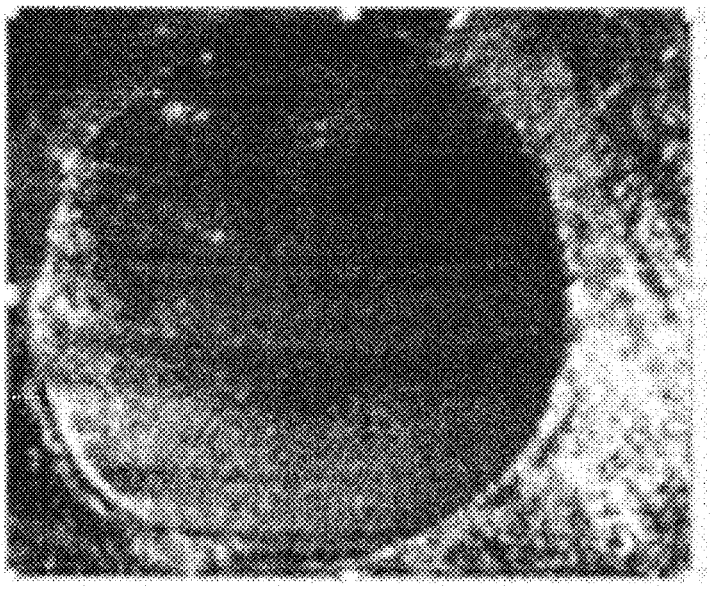
FIG. 16A is a photograph of a metal surface following extreme pressure testing, i.e., 4-ball test (ASTM D2783, AISI 52100) for weld loading, in which the metal surface was lubricated with one embodiment of an industrial lubricant composition including intercalation compounds of metal chalcogenide in accordance with the present disclosure.
Figure 16B:
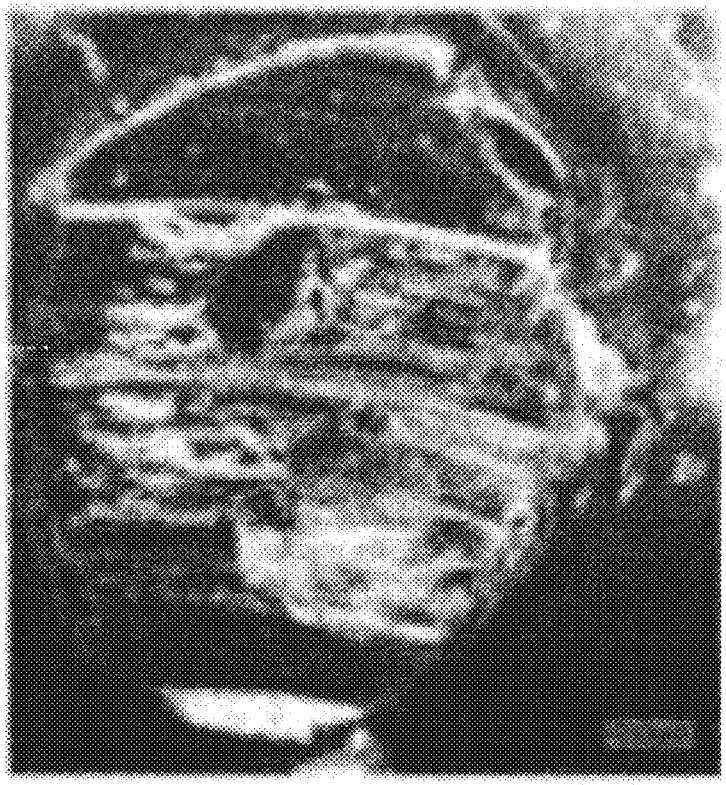
FIGS. 16B-16D are photographs of a metal surface of comparative examples following extreme pressure, i.e., 4-ball test (ASTM D2783, AISI 52100) for weld loading, in which the metal surface was lubricated with an industrial lubricant composition that does not include an intercalation compound of metal chalcogenide.
Figure 16C:
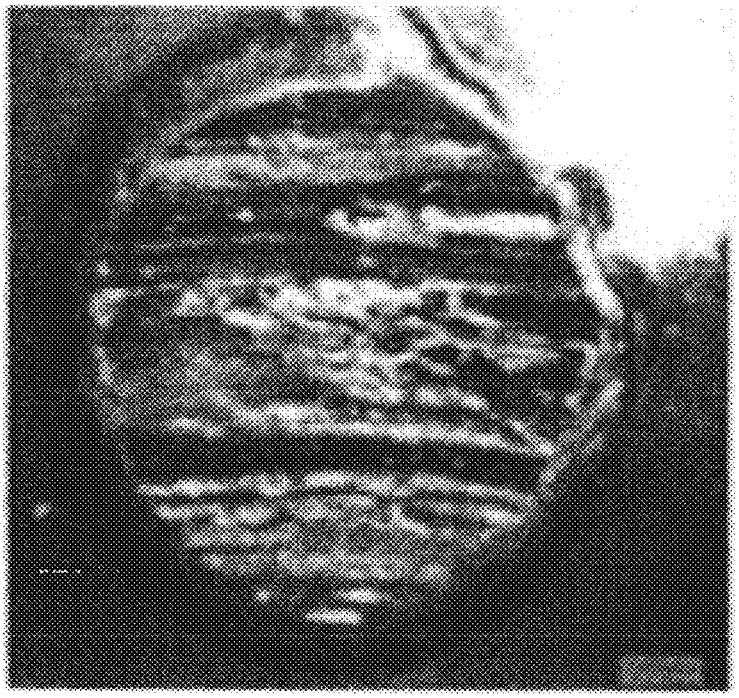
Figure 16D:
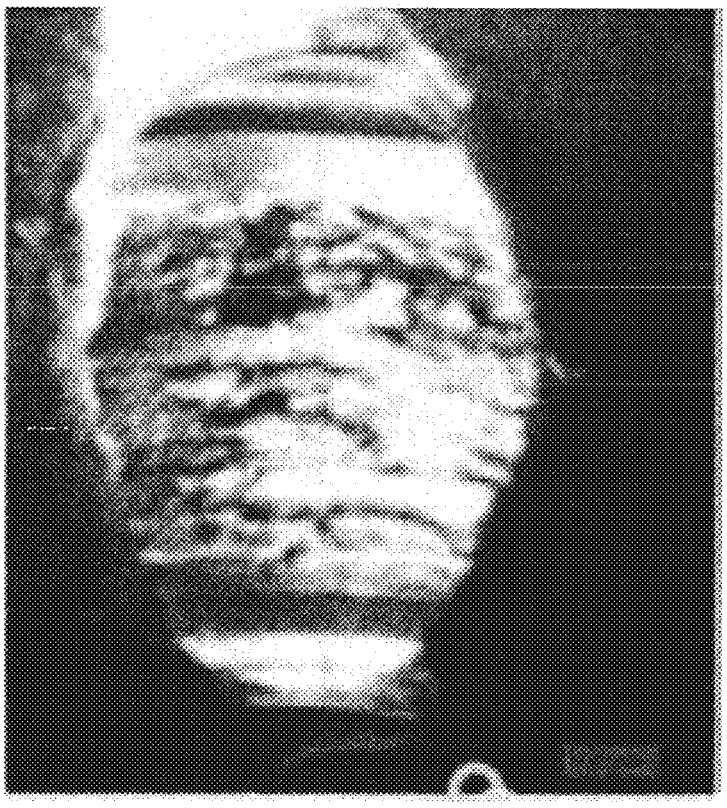

FIG. 16A is a photograph of a metal surface following extreme pressure testing, i.e., 4-ball test (ASTM D2783, AISI 52100) for weld loading, in which the metal surface was lubricated with an industrial lubricant having Composition 1, as listed in Table 1. FIG. 16B is a photograph of a metal surface following extreme pressure testing, i.e., 4-ball test (ASTM D2783, AISI 52100) for weld loading, in which the metal surface was lubricated with metalcut t20 from Metalflow S.A. FIG. 16C is a photograph of a metal surface following extreme pressure testing, i.e., 4-ball test (ASTM D2783, AISI 52100) for weld loading, in which the metal surface was lubricated with Condaform 989 from Condat Lubricants. FIG. 16D is a photograph of a metal surface following extreme pressure testing, i.e., 4-ball test (ASTM D2783, AISI 52100) for weld loading, in which the metal surface was lubricated with Matrol EP405CF from Total Lubricants USA, Inc.

Figure 17:
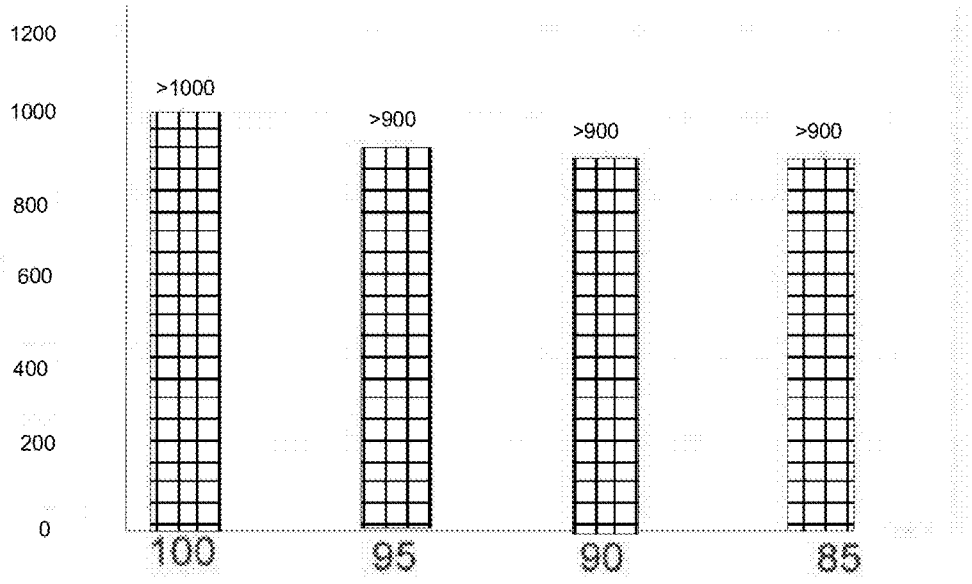
FIG. 17 is a plot illustrating the extreme pressure testing data measured from a 4 ball test (ASTM D2783, AISI 52100) for weld load, of additional embodiments of industrial compositions including intercalation compounds of metal chalcogenide, in accordance with the present disclosure.

FIG. 17 is a plot illustrating the extreme pressure testing data measured from a 4 ball test (ASTM D2783, AISI 52100) for weld load, from test samples lubricated with industrial lubricant Compositions 1-4, as illustrated in Tables 1-4.

The plot identified by reference number 85 is the maximum weld load measured from a tested sample that was lubricated with an industrial lubricant having Composition 2, which included at least an industrial lubricant of a paraffinic oil base having a viscosity of 475P, inorganic fullerene type metal chalcogenide, $WS_2$, intercalation agent, and extreme pressure sensitive additive provided of amine phosphate. The plot identified by reference number 90 is the maximum weld load measured from a tested sample that was lubricated with an industrial lubricant having Composition 1, which included at least an industrial lubricant of a paraffinic oil base having a viscosity of 125P, inorganic fullerene type metal chalcogenide, $WS_2$, intercalation agent, and extreme pressure sensitive additive provided of amine phosphate. The plot identified by reference number 95 is the maximum weld load measured from a tested sample that was lubricated with an industrial lubricant having Composition 3, which included a gas to liquid (GTL) formed paraffinic oil base, inorganic fullerene type metal chalcogenide, i.e., $WS_2$, intercalation agent, and extreme pressure sensitive additive provided of amine phosphate. The plot identified by reference number 100 is the maximum weld load measured from a tested sample that was lubricated with an industrial lubricant having Composition 4, which included a grape seed oil base, inorganic fullerene type metal chalcogenide, i.e., $WS_2$, intercalation agent, and extreme pressure sensitive additive provided of amine phosphate.

Referring to FIG. 17, the measured maximum weld load for the samples lubricated by the industrial lubricants having Compositions 1-4 including an intercalation compound of metal chalcogenide was approximately 900 kg or greater.

The industrial lubricant formulations that employed a grape seed oil base, inorganic fullerene type metal chalcogenide, i.e., $WS_2$, intercalation agent, and extreme pressure sensitive additive of amine phosphate, such as Composition 4, where characterized as having excellent anti-wear properties, and met or exceeded the requirements of extreme pressure applications, e.g., having weld loads greater than 1000 kg. In some examples, replacing the grade seed oil component of the industrial lubricants with a mineral oil base, such as in Compositions 1, 2 and 3, provided increased stability for the industrial lubricant. The industrial lubricants composed of a mineral oil base, inorganic fullerene type metal chalcogenide, i.e., $WS_2$, intercalation agent, and extreme pressure sensitive additive of amine phosphate, e.g., Compositions 1, 2 and 3, maintained extreme pressure performance in comparison to the grade seed containing industrial lubricant compositions, e.g., Composition 4. For example, the industrial lubricants composed of a mineral oil base, inorganic fullerene type metal chalcogenide, i.e., $WS_2$, intercalation agent, and extreme pressure sensitive additive of amine phosphate, e.g., Compositions 1, 2 and 3, exhibited measurable extreme pressure performance in which the weld load was equal to 900 kg or greater.

While the claimed methods and structures has been particularly shown and described with respect to preferred embodiments thereof, it will be understood by those skilled in the art that the foregoing and other changes in form and details may be made therein without departing from the spirit and scope of the presently claimed methods and structures.

What is claimed is:

1. An industrial lubricant composition comprising:

an oil base selected from the group consisting of vegetable oil, Group I type oil, Group II type oil, Group III type oil, Group IV type oil, Group V type oil and combinations thereof;

a phosphorus-based non-chlorine additive; and at least one intercalation compound of a metal chalcogenide, a carbon containing compound and a boron containing compound, wherein the intercalation compound may have a geometry that is a platelet shaped geometry, a spherical shaped geometry, a multi-layered fullerene-like geometry, a tubular-like geometry or a combination thereof, wherein the industrial lubricant is for lubricating metal substrates in working applications that change the geometry of the metal substrate.

2. The composition of claim 1, wherein the vegetable oil is an oil selected from the group consisting of canola oil, coconut oil, corn oil, cottonseed oil, olive oil, palm oil, peanut oil rapeseed oil, safflower oil, sesame oil, soybean oil, sunflower oil, almond oil, beech nut oil, cashew oil, hazelnut oil, macadamia oil, mongongo nut oil, pecan oil, pine nut oil, pistachio oil, walnut oil, grapefruit seed oil, lemon oil, orange oil, watermelon seed oil, bitter gourd oil, bottle gourd oil, buffalo gourd oil, butternut squash seed oil, egusi seed oil, pumpkin seed oil, blackcurrant seed oil, evening primrose oil, açaí oil, black seed oil, blackcurrant seed oil, borage seed oil, evening primrose oil, flaxseed oil, amaranth oil, apricot oil, apple seed oil, argan oil, avocado oil, babassu oil, ben oil, borneo tallow nut oil, cape chestnut oil, carob pod oil (algaroba oil), cocoa butter, *theobroma* oil, cocklebur oil, cohune oil, coriander seed oil, date seed oil, dika oil, false flax oil, grape seed oil, hemp oil, kapok seed oil, kenaf seed oil, lallemantia oil, mafura oil, mafura butter, marula oil, meadowfoam seed oil, mustard oil, *niger* seed oil, nutmeg butter, okra seed oil, *papaya* seed oil, *perilla* seed oil, persimmon seed oil, pequi oil, pili nut oil, pomegranate seed oil, poppyseed oil, prune kernel oil, *quinoa* oil, ramtil oil, rice bran oil, royle oil, sacha inchi oil, sapote oil, seje oil, shea butter, taramira oil, tea seed oil (*Camellia* oil), thistle oil, tigernut oil, tobacco seed oil, tomato seed oil, wheat germ oil, peppermint oil and combinations thereof.

3. The composition of claim 1, wherein the metal chalcogenide has a molecular formula MX2, where M is a metallic element selected from the group consisting of titanium (Ti), vanadium (V), chromium (Cr), manganese (Mn), iron (Fe), cobalt (Co), nickel (Ni), copper (Cu), zinc (Zn), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Jr), platinum (Pt), gold (Au), mercury (Hg) and combinations thereof, and X is a chalcogen element selected from the group consisting of sulfur (S), selenium (Se), tellurium (Te), oxygen (O) and combinations thereof.

4. The composition of claim 1, wherein the multi-layered fullerene-like geometry has a hollow core.

5. The composition of claim 1, wherein the multi-layered fullerene-like geometry has a solid core.

6. The composition of claim 1, wherein an outer layer of the multi-layered fullerene-like structure comprises at least one sectioned portion, the at least one sectioned portion extends along a direction away from the curvature of the multi-layered fullerene-like nano-structure, the at least one sectioned portion engaged to remaining section of the outer layer.

7. The composition of claim 1, wherein the multi-layered fullerene-like nano-structure is substantially spherical.

8. The composition of claim 1, wherein the multi-layered fullerene-like nano-structure has a diameter ranging from 5 nm to 5 microns.

9. The composition of claim 1, wherein the outer layer of the multi-layered fullerene-like nano-structure is functionalized with functionalizing agents selected from the group consisting of silanes, thiols, ionic, anionic, cationic, non-ionic surfactants, amine based dispersant and surfactants, succinimide groups, fatty acids, acrylic polymers, copolymers, polymers, monomers and combinations thereof.

10. The composition of claim 1, wherein the phosphorus-based non-chlorine additive is selected from the group consisting of amine phosphates, tertiary alkylamines, dialkylamine, alkylamine or alkanolamine salts of phosphoric acid, butylamine phosphates, long chain alkyl amine phosphates, organophosphites, propanolamine phosphates, hydrocarbon amine phosphates, triethanol, monoethanol, dibutyl, dimethyl, or monoisopropanol amine phosphates, diphenylamine, amides of phosphorous containing acids, phosphate esters and combinations thereof.

11. The composition of claim 1, wherein the phosphorus-based non-chlorine additive is a polar molecule.

12. The composition of claim 1, wherein a 4-ball extreme pressure test (weld load) in accordance with ASTM spec D2783 applied to a metal surface lubricated with the composition provided a value greater than 250 Kg.

13. The composition of claim 1, wherein a 4-ball extreme anti-wear test including a 40 kg load for 1 hour at 1200 rpm in accordance with ASTM D4172 applied to a metal surface lubricated with the composition provided a value greater than 510 μm.

14. The composition of claim 1, wherein the intercalation compound having the multi-layered fullerene-like geometry, the tubular-like geometry or the combination of the fullerene-like geometries and the tubular-like geometry exfoliates tribofilm lamellae into contact between metal surfaces of a working tool and the metal substrate during said working the metal substrate, wherein the tribofilm lamellas to provide a lubricating surface to each of the working tool and the metal substrate.

15. The composition of claim 1, wherein the at least one intercalation compound has an outer layer comprising at least one sectioned portion, the at least one sectioned portion extends along a direction away from the curvature of the multilayered structure, the at least one sectioned portion engaged to a remaining section of the outer layer.

* * * * *